US009669971B2

(12) United States Patent
Panec et al.

(10) Patent No.: US 9,669,971 B2
(45) Date of Patent: Jun. 6, 2017

(54) VALVE SYSTEM

(71) Applicant: ACORN BAY, Novato, CA (US)

(72) Inventors: Donald J Panec, Novato, CA (US); Kathryn Kelsey Anne Stillinger, Monte Sereno, CA (US); Scott H Stillinger, Monte Sereno, CA (US)

(73) Assignee: Acorn Bay, Novato, CA (US)

( * ) Notice: Subject to any disclaimer, the term of this patent is extended or adjusted under 35 U.S.C. 154(b) by 0 days.

(21) Appl. No.: 15/243,927

(22) Filed: Aug. 22, 2016

(65) Prior Publication Data

US 2017/0066571 A1 Mar. 9, 2017

Related U.S. Application Data

(63) Continuation of application No. PCT/US2016/047931, filed on Aug. 20, 2016.

(60) Provisional application No. 62/208,020, filed on Aug. 21, 2015.

(51) Int. Cl.
*B67D 3/00* (2006.01)
*B65D 47/24* (2006.01)

(52) U.S. Cl.
CPC ..... *B65D 47/242* (2013.01)

(58) Field of Classification Search
CPC ..... B65D 35/46; B65D 35/44; B65D 41/04; B65D 41/62; B65D 47/242
USPC ..... 222/492, 493, 521
See application file for complete search history.

(56) References Cited

U.S. PATENT DOCUMENTS

| | | | | |
|---|---|---|---|---|
| 2,135,237 | A * | 11/1938 | Lewis | B65D 47/2037 138/89.3 |
| 2,309,895 | A * | 2/1943 | Griffith | B65D 47/2037 222/490 |
| 5,143,236 | A | 9/1992 | Gueret | |
| 5,226,568 | A | 7/1993 | Newton | |
| 5,743,443 | A | 4/1998 | Hins | |
| 5,938,086 | A | 8/1999 | Gross | |
| 8,011,535 | B2 | 9/2011 | Tauber | |
| 2002/0121525 | A1 | 9/2002 | Stillinger | |

(Continued)

OTHER PUBLICATIONS

International Searching Authority—United States, "International Search Report and Written Opinion", Office Correspondence, Nov. 7, 2016, 11 pages.

(Continued)

*Primary Examiner* — Patrick M Buechner
(74) *Attorney, Agent, or Firm* — Alleman Hall Creasman & Tuttle LLP

(57) ABSTRACT

A valve system includes a fitment or a fluid container having a threaded spout, a valve assembly, and a cap. The threaded spout has external threads. The valve assembly includes a sleeve forming a barrel. The barrel includes internal threads and external threads. The internal threads accommodate the external threads of the spout at a first end of the barrel. The valve assembly further includes a valve located at a second end of the barrel. The valve is operable to open and close an internal fluid pathway of the valve assembly. The cap defines an interior region that includes internal threads that accommodate the external threads of the barrel. The cap accommodates the valve within the interior region when the internal threads of the cap are fully threaded onto the external threads of the barrel. The cap may contact the valve to provide an additional seal.

20 Claims, 16 Drawing Sheets

(56) References Cited

U.S. PATENT DOCUMENTS

| | | | | |
|---|---|---|---|---|
| 2004/0050884 | A1* | 3/2004 | Boggs | B65D 47/127<br>222/520 |
| 2005/0274741 | A1* | 12/2005 | Cho | B65D 55/16<br>222/153.14 |
| 2016/0257473 | A1* | 9/2016 | Bugenske | B65D 41/04 |

OTHER PUBLICATIONS

Choomee Inc., "Sip'n", website, retrieved Jul. 20, 2015, 16 pages, http://www.choomee.com/sipn/.

Aptargroup Inc., "VersaSpout", website, retrieved May 20, 2015, 1 page, http://www.aptar.com/food-beverage/beverage/application-fields?cat=dairy&id=versaspout.

Backcountrygear.com, "Platypus HyperFlow Cap", website, retrieved Aug. 3, 2015, 4 pages, http://www.backcountrygear.com/platypus-hyperflow-cap.html.

Moontrail, "Platypus Platy Soft Bottle 1L", website, retrieved Aug. 3, 2015, 3 pages, http://www.moontrail.com/ platypus-platy-soft-bottle-1l.php.

* cited by examiner

VALVE SYSTEM

CROSS-REFERENCE TO RELATED APPLICATIONS

The present application claims priority to and the benefit of U.S. provisional patent application Ser. No. 62/208,020, titled VALVE SYSTEM, filed Aug. 21, 2015, the contents of which are incorporated herein by reference in their entirety for all purposes. The present application also claims, under 35 U.S.C. Sects. 120 and 363, priority to and the benefit of International PCT patent application serial number PCT/US16/47931 designating the United States, titled VALVE SYSTEM, filed Aug. 20, 2016, the contents of which are incorporated herein by reference in their entirety for all purposes.

FIELD

The subject matter of the present disclosure relates generally to the field of valves for sealing containers and dispensing fluid contents from the containers.

BACKGROUND

Valves may be used to reduce spillage of fluids from containers or to limit fluid flow along a fluid pathway. Food grade containers are typically sealed to ensure product integrity during transport and storage over an expected shelf life.

SUMMARY

In accordance with an aspect of the present disclosure, a valve system includes a valve assembly, a fitment or a fluid container having a threaded spout, and a cap. The valve assembly includes a sleeve forming a barrel. The barrel includes internal threads and external threads. The threaded spout has external threads, and can be inserted into a first end of the barrel. The internal threads of the barrel engage with the external threads of the spout.

The valve assembly further includes a valve located at a second end of the barrel. The valve is operable to open and close an internal fluid pathway of the valve assembly. The cap defines an interior region that includes internal threads that engage with the external threads of the barrel. The cap accommodates the valve (and some or all of the barrel of the sleeve) within the interior region when the internal threads of the cap are fully threaded onto the external threads of the barrel.

Throughout the various examples disclosed herein, the cap and/or the sleeve may contact and/or compress the valve to form one or more annular seals. Additionally or alternatively, the cap may contact and/or compress the sleeve to form an annular seal. Additionally or alternatively, the spout may contact and/or compress the sleeve to form an annular seal.

This summary describes only some of the concepts presented in further detail by the following detailed description. As such, claimed subject matter is not limited by the contents of this summary.

DETAILED DESCRIPTION

Figure 1A:
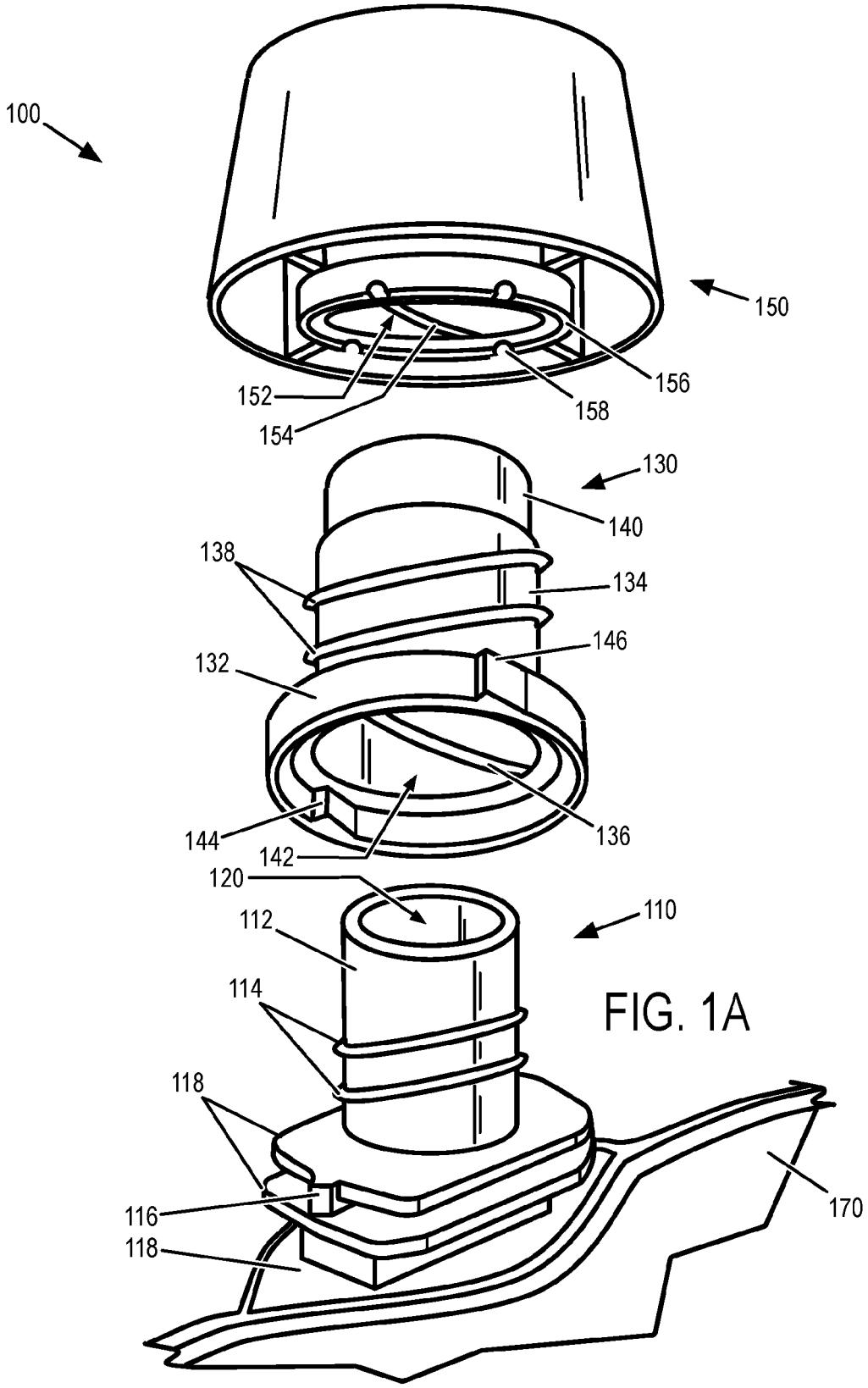
FIG. 1A depicts an exploded view of an example valve system.

In accordance with an aspect of the present disclosure, a valve system includes a valve assembly, a fitment or a fluid container having a threaded spout, and a cap. The valve assembly includes a sleeve forming a barrel. The barrel includes internal threads and external threads. The threaded spout has external threads, and can be inserted into a first end of the barrel. The internal threads of the barrel engage with the external threads of the spout.

The valve assembly further includes a valve located at a second end of the barrel. The valve is operable to open and close an internal fluid pathway of the valve assembly. The cap defines an interior region that includes internal threads that engage with the external threads of the barrel. The cap accommodates the valve (and some or all of the barrel of the sleeve) within the interior region when the internal threads of the cap are fully threaded onto the external threads of the barrel.

Throughout the various examples disclosed herein, the cap and/or the spout may contact and/or compress the valve to form one or more annular seals. Compression of the valve by the cap or spout may be: (1) primarily along a longitudinal direction of the barrel, (2) primarily orthogonal to a longitudinal axis of the barrel, or (3) may incorporate compression in a direction that includes a combination of longitudinal and orthogonal force vectors relative to the longitudinal axis of the barrel. Within the disclosed examples, compression of the valve in a direction that is orthogonal to the longitudinal axis of the barrel is typically achieved by interference between an annular region of the valve and an annular region of the cap or spout in a radial direction from the longitudinal axis, while compression of the valve in a direction that is parallel to the longitudinal axis is typically achieved by compression of a flange that projects outward or inward in a radial direction from an annular wall of the valve. Additionally or alternatively, the cap may contact and/or compress the sleeve to form an annular seal. Additionally or alternatively, the spout may contact and/or compress the sleeve to form an annular seal.

In the above examples, the valve system may include two threaded interfaces, including a first threaded interface between a cap and a valve assembly, and a second threaded interface between the valve assembly and a spout of a fitment or a fluid container. In other examples, one or more of the threaded interfaces may be replaced by a press-fit or snap-fit interface.

In a product manufacturing context, a fluid container may be filled with a fluid product via the spout, and the disclosed valve assembly may be threaded onto the spout either alone or in combination with the a pre-threaded cap after filling the fluid container. This second threaded interface, upon threading the valve assembly onto the spout, may include a locking feature that precludes removal of the valve assembly from the spout by the consumer. This interface between the spout and the valve assembly may include a press-fit or snap-fit as previously discussed.

By contrast, the first threaded interface between the cap and the valve assembly may be freely threaded and unthreaded by consumers to either seal the valve or to provide access to the fluid contents of the container. The cap in combination with the valve assembly, and the valve assembly in combination with the spout may provide respective food grade seals and/or FDA-compliant seals suitable for transport, storage, and sale of fluids contained within the container that are consumable by humans or animals. This double-threaded valve system may enable the same automation process and/or automation equipment currently used for threading caps onto threaded spouts to be used for threading a cap onto the valve assembly and/or for threading the valve assembly (including a pre-threaded cap or excluding the cap) onto the threaded spout of the fitment or fluid container.

FIG. 1A depicts an exploded view of an example valve system 100. Valve system 100 includes a fitment 110, a valve assembly 130, and a cap 150. Fitment 110 may be joined with a mouth of a fluid container or integrated with a fluid container (e.g., as a fluid container that includes an integrated spout). A portion of an example fluid container 170 is depicted in FIG. 1A. A fluid container may be rigid or flexible. Non-limiting examples of flexible fluid containers include pouches, deformable plastic bottles, and deformable boxes. With regards to pouches or boxes, the fitment may be joined to the pouch by heat-sealing opposing sides of the pouch or box around a base of the fitment, for example.

Figure 1B:
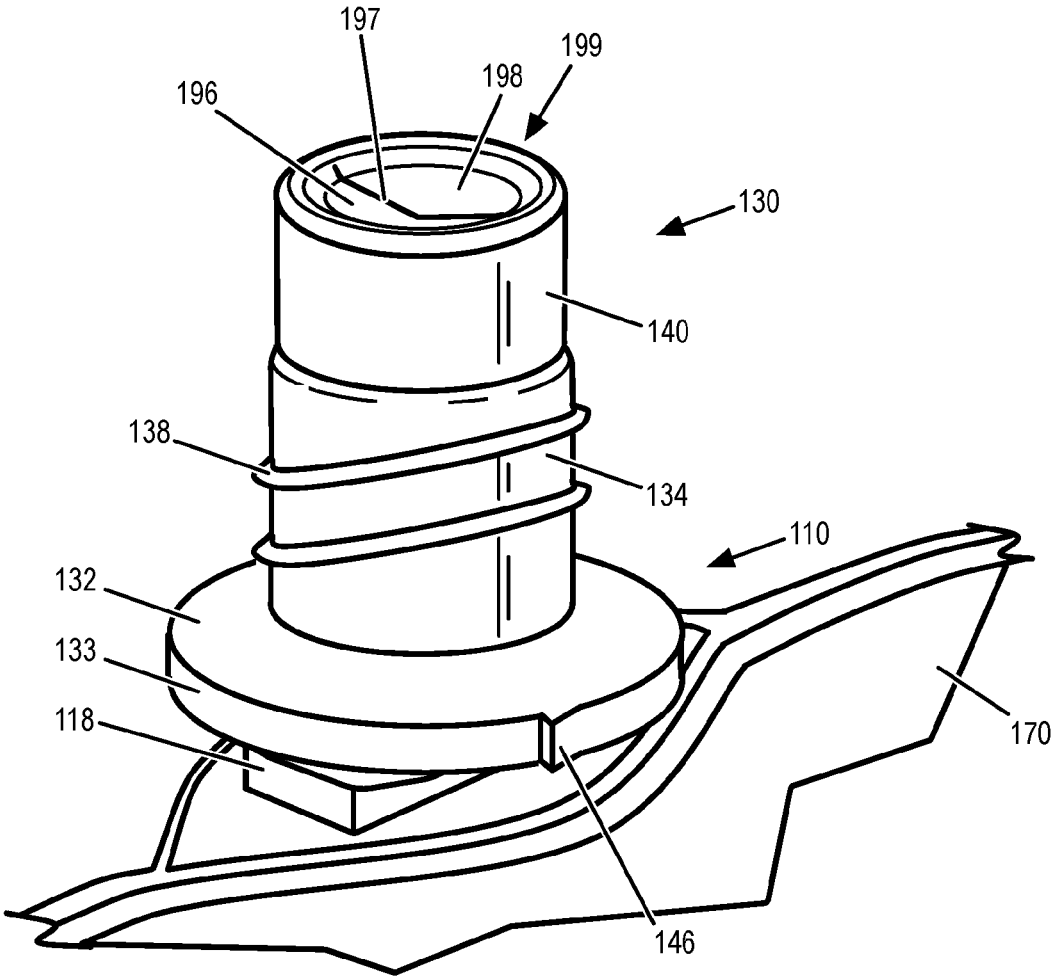
FIG. 1B depicts a view of the example valve system of FIG. 1A with the valve assembly threaded onto the fitment.

Fitment 110 includes a spout 112 defining an internal fluid pathway 120 that communicates with an interior of container 170. Spout 112 takes the form of a threaded spout having external threads 114 in this example. Valve assembly 130 includes a sleeve 132 forming a barrel 134. Barrel 134 includes internal threads 136 and external threads 138. Internal threads 136 of barrel 134 engage with external threads 114 of spout 112 at a first end of the barrel (i.e., the lower end of the barrel in FIG. 1). As depicted in FIG. 1B, barrel 134 accommodates some or all of spout 112 within the first end of the barrel in the fully threaded configuration.

Sleeve 132 may further include a collar 133 at the first end of the barrel in at least some examples. Tamper-evident catch 146 is depicted in this example as being located on an outer edge of collar 133. Collar 133 may include a plurality of similarly configured catches to tamper-evident catch 146 arranged along the outer edge of collar 133 at any suitable angular spacing. As previously described with reference to FIG. 1A, tamper-evident catches located on an exterior of sleeve 132, such as tamper-evident catch 146, may engage with corresponding tamper-evident catches 158 of a tamper-evident band 156 of the cap.

Valve assembly 130 further includes a valve 140 located at a second end of the barrel (i.e., the upper end of the barrel in FIG. 1). Alternatively, a valve may be located or otherwise incorporated into the valve assembly along an intermediate portion of the barrel. Valve 140 is operable to open and close an internal fluid pathway 142 of valve assembly 130. Valve 140 may take the form of a food grade and/or FDA-compliant valve (e.g., suitable for beverages or medicines), in an example. In other examples, valve 140 may be suitable for a particular fluid, such as solvents, adhesives, cleaning products, etc.

Cap 150 defines an interior region 152 that accommodates at least a portion of valve assembly 130. In an example, interior region 152 includes internal threads 154 that engage with external threads 138 of barrel 134. In an example, cap 150 accommodates valve 140 within interior region 152 in a configuration where internal threads 154 of the cap are threaded (e.g., fully threaded) onto external threads 138 of barrel 134. For example, external surfaces of valve 140 that are visible in FIG. 1 may be fully surrounded or otherwise encapsulated by cap 150 in a fully threaded configuration. Interior region 152 of cap 150 may further accommodate some or all of barrel 134 in the fully threaded configuration. FIGS. 2-8 depict examples in which the cap surrounds the valve and the barrel of the sleeve in a fully threaded configuration.

A pitch and pitch direction may be the same for external threads 114 of fitment 110, internal threads 136 of barrel 134, external threads 138 of barrel 134, and internal threads 154 of cap 150. As an example, the pitch and pitch direction of all threads of valve system 100 may be the same as currently used in spout/cap interfaces of commercially available fluid containers.

In at least some implementations, a first turning resistance of valve assembly 130 relative to fitment 110 across a threaded interface formed between threads 114 and 136 (e.g., in an unthreading direction of rotation) may be substantially greater than a second turning resistance of valve assembly 130 relative to cap 150 across another threaded interface formed between threads 138 and 154 (e.g., in an unthreading direction of rotation) to thereby enable the cap to be unthreaded from the valve assembly without the valve assembly being unthreaded from the fitment in response to a relative turning force being applied in the unthreading direction between the cap and the fitment.

As an example, turning resistance in an unthreading direction of rotation may be increased between valve assembly 130 and fitment 110 across a threaded interface formed between threads 114 and 136 by sleeve 132 including a first locking catch 144 formed at or near a first end of the barrel or upon an interior edge of collar 143, and fitment 110 including a second locking catch 116 that engages first locking catch 144 in a configuration where internal threads 136 of the barrel and external threads 114 of the fitment are in a threaded or fully threaded state. In this threaded or fully threaded state, first locking catch 144 engages with second locking catch 116 to increase turning resistance and/or to preclude rotation between fitment 110 and valve assembly 130 in an unthreading turning direction. The valve system may include a plurality of similarly configured locking catches radially located along the spout and the sleeve that engage with each other as previously described with reference to catches 144 and 116. These catches may take the form of an inclined surface that enables the catches to slide past and over each other during manufacturing of the valve system, and a less inclined or orthogonal surface against which the catches interface with each other to inhibit unthreading of the sleeve relative to the spout.

As another example, turning resistance may be increased between valve assembly 130 and fitment 110 across a threaded interface formed between threads 114 and 136 by increasing turning resistance between external threads 114 of the fitment and internal threads 136 of the barrel by one or more of: (1) oversized male thread elements of external threads 114 relative to female thread elements of internal threads 136, (2) surface structure or surface treatment upon mating surfaces of the thread elements of threads 114 and 136, such as ridges, texture, or adhesive, (3) surface structure or surface treatment of interior wall surfaces of the barrel and/or exterior wall surface of the spout.

Valve 140 may include an elastomeric valve or a non-elastomeric valve, as non-limiting examples. Examples of non-elastomeric include mechanical valves, such as a ball valve, a two-position or multi-position push/pull valve, etc. Non-elastomeric valves are typically formed from rigid enclosure materials in contrast to compliant materials that form elastomeric valves. An elastomeric valve may be deformable to open internal fluid pathway 142 across the valve the valve assembly, and may return to a non-deformed state to close internal fluid pathway 142 across the valve of the valve assembly. Non-limiting examples of elastomeric valves include pressure differential valves and/or bite valves. As described in further detail herein, the compliant nature of an elastomeric valve enables the valve to be compressed by the cap and/or spout to provide one or more annular seals. Typically, the cap, sleeve, and spout are formed from rigid materials, such as a plastic, as described in further detail herein.

In at least some implementations, wall surfaces of interior region 152 of cap 150 contact an elastomeric valve (as valve 140) in a configuration where internal threads 154 of the cap are threaded or fully threaded onto external threads 138 of sleeve 130. FIGS. 2-8 depict section views of example configurations and interfaces between a cap, a valve assembly, and a spout of a valve system, which may take the form of valve system 100 of FIG. 1A.

As an example, wall surfaces of interior region 152 of cap 150 contact the elastomeric valve along an annular region of the elastomeric valve that is backed by an annular portion of the sleeve in the examples configurations depicted in FIGS. 2-8. In these examples, the wall surfaces of the interior region of the cap compress the annular region of the elastomeric valve between and onto the annular portion of the sleeve in a vertical direction (e.g., relative to an axis of the fluid pathway) to provide a seal, such as a food grade seal and/or an FDA-compliant seal. For example, the annular region of the elastomeric valve may be located at a flange of the valve.

FIGS. 2-7 depict example valve systems in which wall surfaces a cap and/or wall surfaces of a spout compress the elastomeric valve onto wall surfaces of a barrel of a sleeve in a threaded or fully threaded configuration to provide one or more annular seals. In these examples, the elastomeric valve is compressed along one or more annular regions between corresponding annular wall surfaces of the barrel and the cap, and between corresponding annular wall surfaces of the barrel and the spout. Compression of the elastomeric valve by the cap may be inward towards a longitudinal axis of the valve system and/or downward (e.g., in a counter-flow direction) along a direction that is parallel to the longitudinal axis of the valve system towards the container and base of the fitment. Compression of the elastomeric valve by the spout may be outward away from the longitudinal axis of the valve system and/or upward (e.g., in a flow direction) along a direction that is parallel to the longitudinal axis of the valve system away from the container and base of the fitment. An annular seal provided by compression of the elastomeric valve along one or more annular regions may collectively provide a food grade seal and/or an FDA-compliant seal with respect to container contents. Food grade and/or FDA-compliant seals may be achieved by a relatively high compression of the elastomeric valve along one or more annular regions in a threaded or fully threaded configuration of the cap and the sleeve, and in a threaded or fully threaded configuration of the sleeve and the spout. Such compression may collectively provide a seal with respect to container contents that exceeds a bursting pressure of the container. By contrast, FIG. 8 depicts an example valve system in which annular seals are formed between the cap and the sleeve, and the spout and sleeve, without necessarily requiring interaction with the valve.

FIG. 1B depicts a view of example valve system 100 of FIG. 1A with valve assembly 130 threaded onto the fitment 110. In FIG. 1B, a valve face 199 of example valve 140 is visible. In this example, valve 140 takes the form of an elastomeric valve having valve gates 196 and 198 interfacing with each other along a slit 197. Valve 140 may be deformed by an external force applied by a user to cause valve gates 196 and 198 to separate from each other along slit 197 to permit fluid to flow across valve face 199, and out of or into container 170.

Figure 2A:
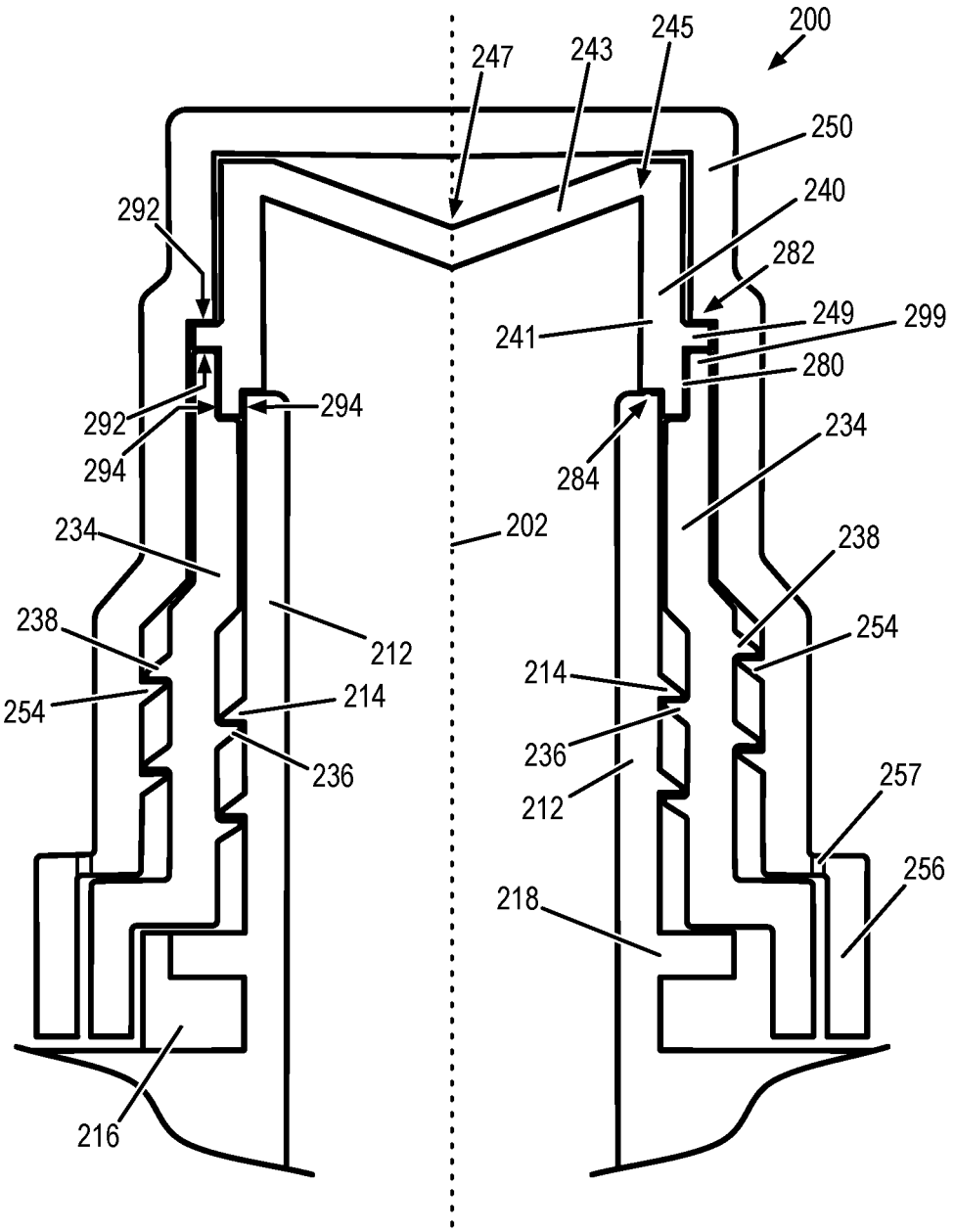
FIG. 2A depicts a section view of a first example valve system.

FIG. 2A depicts a section view of an example valve system 200 along a mid-plane that passes through and contains a longitudinal axis 202 of the valve system. The various components of valve system 200 may take the form of a solid or volume of revolution about longitudinal axis 202 in this example, with the exception of catch 216 and the threads that change pitch with angular rotation about longitudinal axis 202. Valve system 200 is a non-limiting example of previously described valve system 100 of FIG. 1A.

Valve system 200 includes a spout 212 (e.g., of a fitment or a container), a barrel 234 (e.g., of a sleeve), an elastomeric valve 240, and a cap 250. FIG. 2A depicts external threads 214 of spout 212 engaged in a fully threaded configuration with internal threads 236 of an interior region of barrel 234; and external threads 238 of barrel 234 engaged in a fully threaded configuration with internal threads 254 of an interior region of cap 250. In the example depicted in FIG. 2A, when these components are in a threaded onto each other or are in a fully threaded configuration with each other, portions of elastomeric valve 240 are compressed between wall surfaces of cap 250 and wall surfaces of barrel 234 along a first annular region, and portions of the elastomeric valve are compressed between wall surfaces of spout 212 and wall surfaces of barrel 234 along a second annular region.

In this example, elastomeric valve 240 includes an annular wall 241 and a valve face 243 that meet at a transition region 245. Transition region 245 may take the form of a hinge for gate elements of valve face 243 in some examples. Valve face 243, in this example, is concave with respect to a terminal end of valve 240 (i.e., the upper surface of valve 240 in FIG. 2A) along a direction that is parallel to longitudinal axis 202 as indicated at 247. In other examples, valve face 243 may be convex or may be flat (e.g., orthogonal to longitudinal axis 202).

Elastomeric valve 240 interfaces with barrel 234 along an interface 280. Interface 280 is non-linear in this example, and contains interface segments that are orientated at two or more different orientations relative to longitudinal axis 202.

As an example, elastomeric valve 240 may be molded upon barrel 234. In any of the examples described herein, a valve, such as an elastomeric valve, may be attached to a sleeve or other component by double-shot molding, co-molding, insert molding, or over molding, each of which generally refers to a process whereby a first material of a first object is molded onto a second material of a second object. This process results in a chemical and/or heat bond between the two materials. Increasing the surface area between the two materials (e.g., along an interface, such as 280) also increases a strength of the bond. Surface area at an interface between a valve and the sleeve or other component may be increased by a lip, rim, rib, or other suitable structure that provides a non-linear interface. For example, walls defining annular walls of a valve and the annular walls of a barrel of a sleeve may partially overlap with each other in the radial direction from the longitudinal axis to increase surface area at the interface. Additionally or alternatively, mechanical attachment may be used to secure a valve to the sleeve or other component. Examples of mechanical attachment include a press fit between objects, such as via overlapping lip, rim, ridge, or other suitable structure of a first object that overlaps with a retaining sleeve or ring of a second object.

As depicted in FIG. 2A, annular walls 241 of elastomeric valve 240 are compressed by wall surfaces of cap 250 onto wall surfaces barrel 234 to form an annular seal indicated at 282. FIG. 2A also depicts annular walls 241 of elastomeric valve 240 compressed by wall surfaces of spout 212 onto wall surfaces of barrel 234 to form another annular seal indicated at 284. In this example, annular seal 282 is formed at least by compression of annular flange 249 of annular walls 241 by cap 250 onto barrel 234 primarily along a direction that is parallel to longitudinal axis 202 as indicated by force vectors 292, and annular seal 284 is formed at least by compression of a base of annular walls 241 by a terminal end of spout 212 onto barrel 234 primarily outward in an orthogonal direction from longitudinal axis 202 as indicated by force vectors 294. Annular flange 249 protrudes radially outwards from annular walls 241 at an intermediate location along a longitudinal axis of the valve.

Valve face 243 may include one or more slits formed therein that separates valve face 243 into two or more gate members. At least one such slit formed in valve face 243 may pass through longitudinal axis 202 and may extend outward from longitudinal axis 202 towards annular wall 241. When cap 250 is unthreaded and removed from barrel 234, deformation of elastomeric valve 240 by forces applied to exterior surfaces of elastomeric valve 240 (e.g., by a user's mouth, teeth, lips, etc.) may cause the slit to open in valve face 243 to thereby permit fluid to flow through and across the valve face. When cap 250 is threaded onto barrel 234, such deformation of elastomeric valve 240 may be precluded to thereby maintain the slit in valve face 243 in a closed state, and seal the elastomeric valve from fluid flow through or across the valve face.

Within FIG. 2A, a tamper-evident band 256 is depicted as being connected to cap 250 by tamper-evident elements 257. As previously described with reference to FIG. 1A, tamper-evident elements, such as depicted at 257 may be damaged or visually altered by a tamper-evident catch of the sleeve upon a consumer removing the cap follow assembly of the valve system during manufacturing.

Figure 2B:
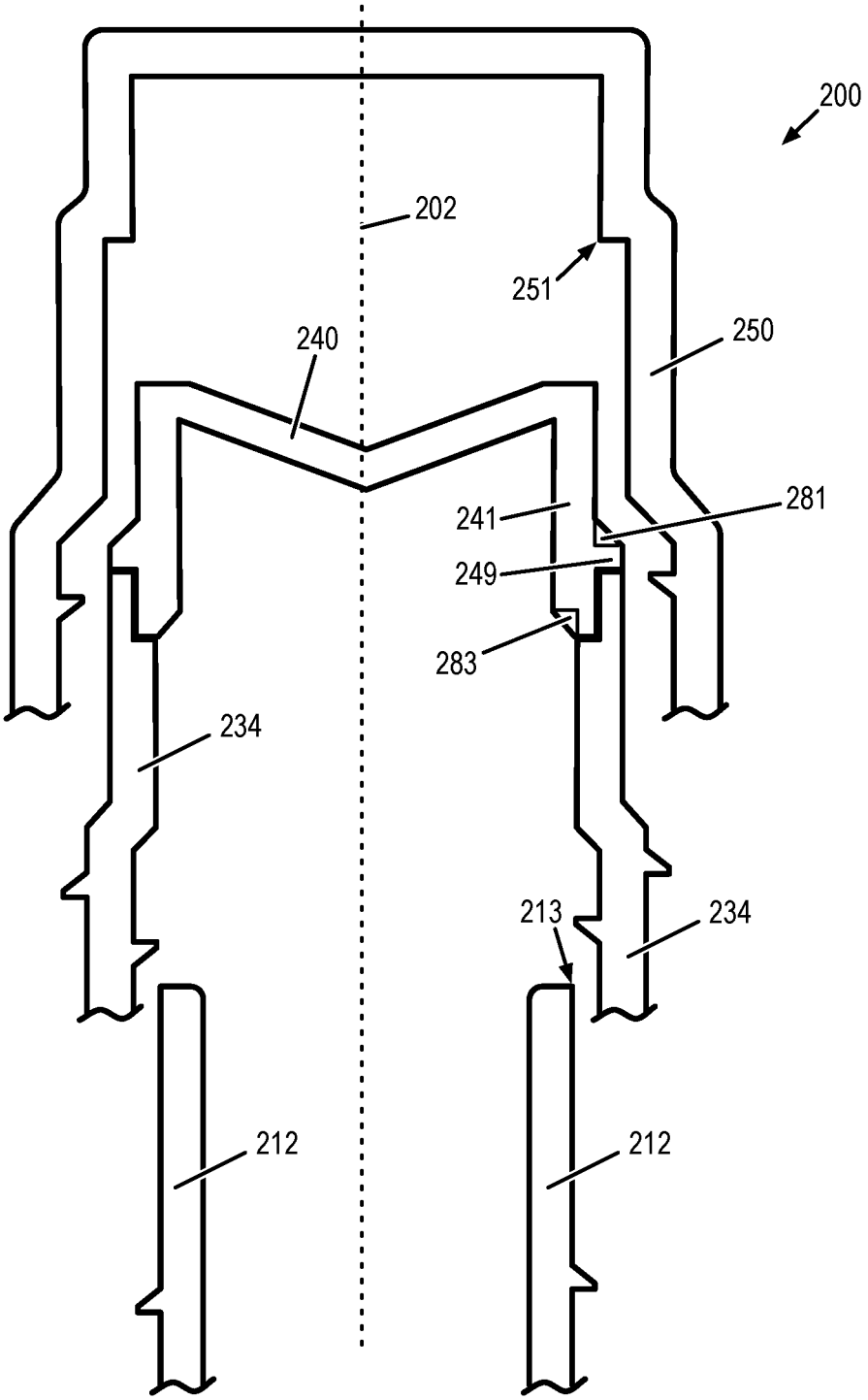
FIGS. 2B and 2C depict exploded views of the valve system of FIG. 2A.

FIG. 2B depicts an exploded view of valve system 200, depicting elastomeric valve 240 in a non-compressed state relative to FIG. 2A. In this example, annular flange 249 includes an annular compression region 281. Annular compression region 281 is compressed downwards in a direction that is parallel to longitudinal axis 202 and/or radially inwards in a direction that is orthogonal to the longitudinal axis by annular wall surfaces 251 of an interior region of cap 250 to form annular seal 282 of FIG. 2A. Annular compression region 281 has an upper surface that tapers from annular walls 241 towards a terminal end of annular flange 249 in this example. However, in other examples, annular compression region 281 may have another suitable shape. Also in this example, an annular compression region 283 formed at a base of valve 240 is compressed upwards and radially outwards against the barrel by annular wall surfaces of a terminal end of spout 212 as indicated at 213 to form annular seal 284. Here, the annular wall of the valve is compressed radially outwards against a wall segment 299 of the barrel that overlaps with the valve, as indicated by force vectors 294.

Figure 2C:
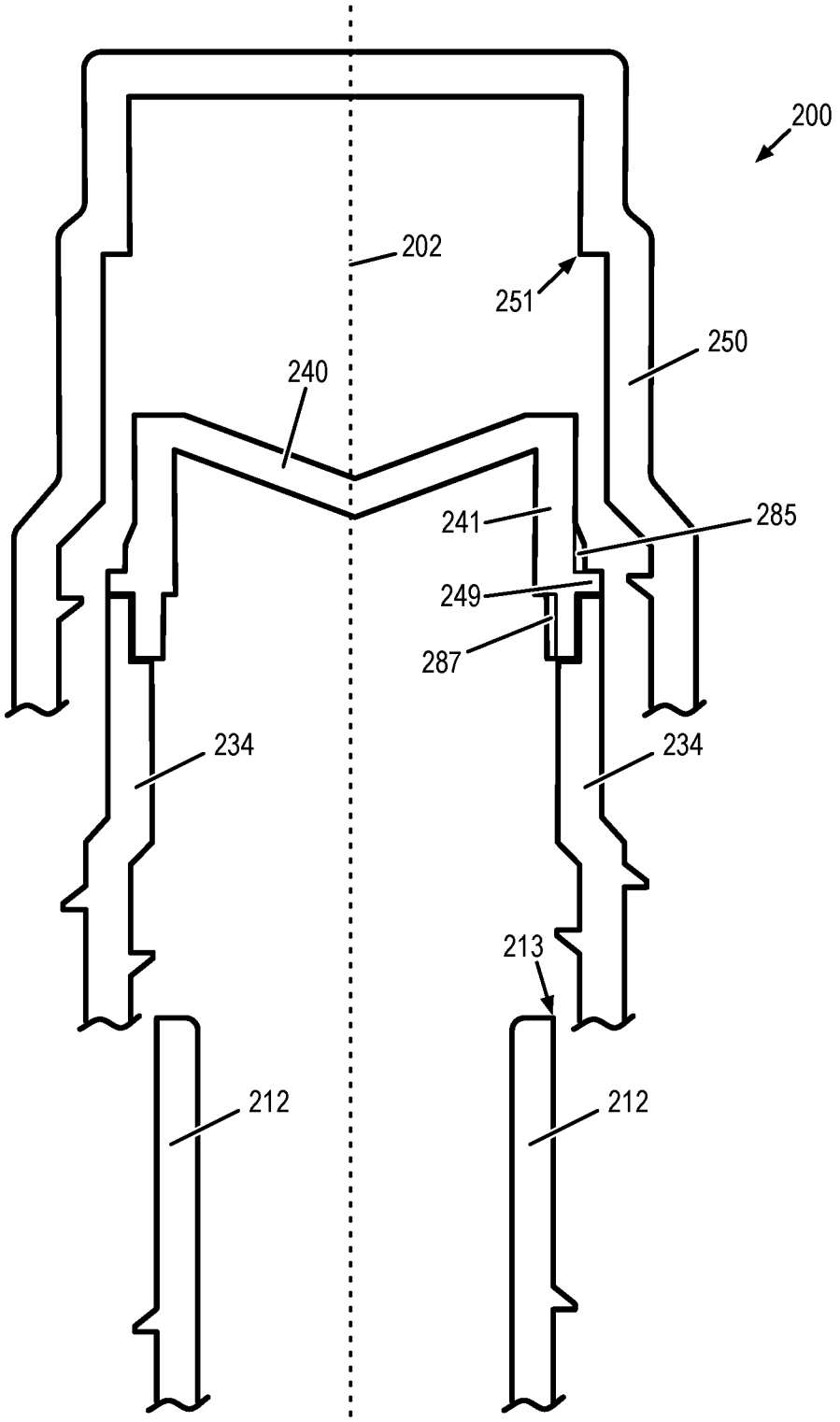

For example, FIG. 2C depicts another example in annular compression region 281 has been replaced with annular compression region 285. Annular compression region 285 is primarily compressed radially inwards by annular wall surfaces 251 of cap 250 in a direction that is orthogonal to the longitudinal axis to form annular seal 282 of FIG. 2A, without necessarily be compressed downwards or with lesser compression downwards in a direction that is parallel to the longitudinal axis. Annular compression region 285 includes a smaller tapering lower surface in this example to thereby primarily support compression orthogonal to the longitudinal axis.

Also in the example depicted in FIG. 2B, a terminal end of annular walls 241 includes an annular compression region 283. Annular compression region 283 is compressed outwards in a direction that is orthogonal to the longitudinal axis and/or upwards in a direction that is parallel to the longitudinal axis by annular wall surfaces 213 of a terminal end of spout 212 to form annular seal 284 of FIG. 2A. Annular compression region 283 has a lower surface that tapers from inner surfaces of annular walls 241 towards a terminal end of annular walls 241 in this example. However, in other examples, annular compression region 283 may have another suitable shape.

For example, FIG. 2C depicts another example in which annular compression region 283 has been replaced with annular compression region 287. Annular compression region 287 is primarily compressed radially outwards by annular wall surfaces 213 of a terminal end of spout 212 in a direction that is orthogonal to the longitudinal axis to form annular seal 284 of FIG. 2A, without necessarily be compressed upwards or with lesser compression upwards in a direction that is parallel to the longitudinal axis. Annular compression region 287 does not include a tapering lower surface in this example to thereby primarily support compression orthogonal to the longitudinal axis.

Figure 3A:
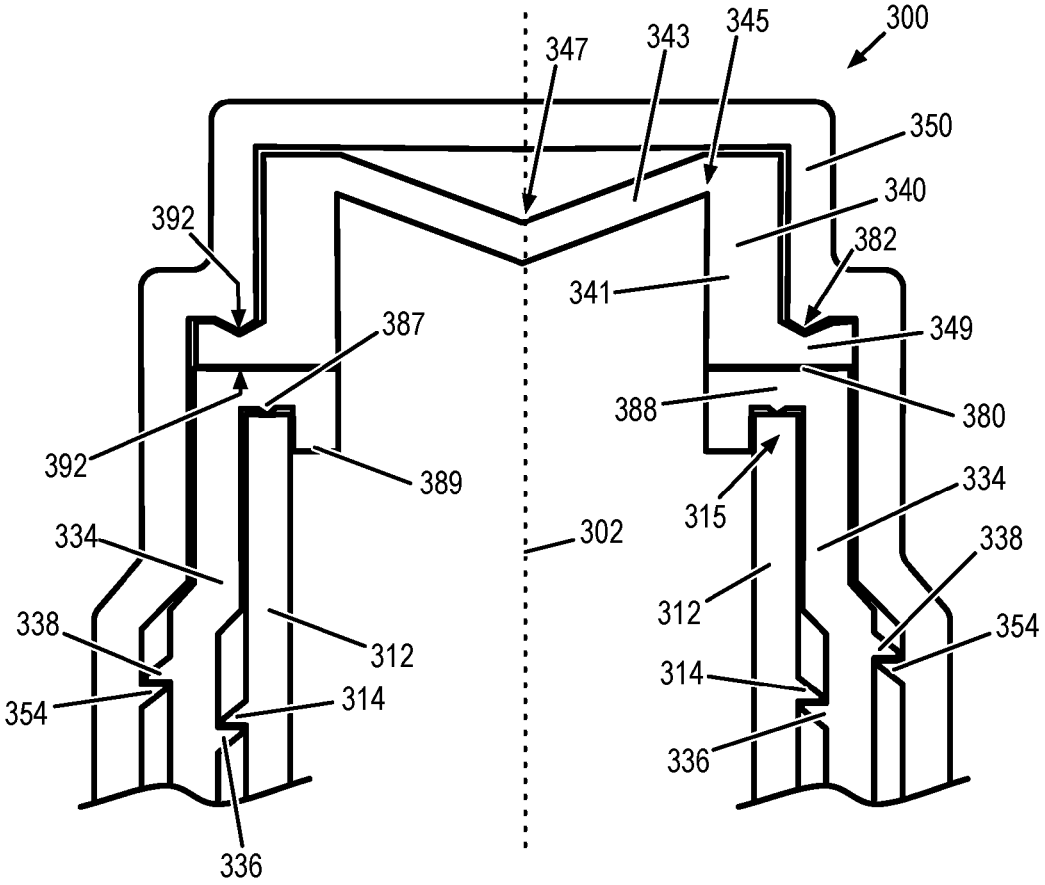
FIG. 3A depicts a section view of a second example valve system.

FIG. 3A depicts a section view of another example valve system 300 along a mid-plane that passes through and contains a longitudinal axis 302 of the valve system. The various components of valve system 300 may take the form of a solid or volume of revolution about longitudinal axis 302 in this example. Valve system 300 is a non-limiting example of previously described valve system 100 of FIG. 1A.

Valve system 300 includes a spout 312 (e.g., of a fitment or a container), a barrel 334 (e.g., of a sleeve), an elastomeric valve 340, and a cap 350. Valve system 300 provides a non-limiting example of an interface between the spout and the sleeve that may take the form of a rigid-on-rigid interface, at least for implementations in which the spout and sleeve are formed from rigid materials.

FIG. 3A depicts external threads 314 of spout 312 engaged in a fully threaded configuration with internal threads 336 of an interior region of barrel 334; and external threads 338 of barrel 334 engaged in a fully threaded configuration with internal threads 354 of an interior region of cap 350. In the example depicted in FIG. 3A, when these components are in a threaded or a fully threaded configuration with each other, portions of elastomeric valve 340 are compressed between cap 350 and barrel 334 along a first annular region, and portions of spout 312 and barrel 334 are compressed onto each other along a second annular region.

In this example, barrel 334 includes an annular flange 388 that protrudes radially inward towards the longitudinal axis of the barrel. A first annular surface of a terminal end of the spout contacts a second annular surface of the annular flange to form a seal 315 between the spout and the barrel of the sleeve. Within the context of the sleeve and the spout being formed from rigid materials, this seal may take the form of a rigid-on-rigid interface that is in contrast to the compliant-on-rigid interface between an elastomeric valve and the cap or spout.

In some examples, the annular flange may include an annular protrusion 387 that contacts the first annular surface of the spout. This annular protrusion 387 may take the form of an annular rib that is referred to as a crush rib within the context of a rigid-on-rigid interaction with the first annular surface of the spout. A crush rib and/or the opposing surface of the spout against which the crush rib is compressed may undergo plastic deformation in some examples. Within the various examples described herein that include or incorporate a crush rib, the crush rib may be optionally omitted to provide substantially planar contact between opposing surfaces. However, the integrity of an annular seal may be increased or improved by including or incorporating a crush rib, particularly for rigid-on-rigid interfaces.

Also in this example, annular flange 388 of barrel 334 further includes an annular wall segment 389 that wraps around upper and inner walls surfaces at the terminal end of spout 312. Annular wall segment 389 may provide additional lateral stability between the spout and the sleeve relative to the longitudinal axis. In some examples, a clearance width between annular wall segment 389 and the barrel wall of the sleeve may be undersized relative to a thickness of the wall of the spout to provide additional sealing and/or retention of the spout relative to the sleeve.

Also in this example, elastomeric valve 340 includes an annular wall 341 and a valve face 343 that meet at a transition region 345. Valve face 343, in this example, is concave with respect to a terminal end of valve 340 (i.e., the upper surface of valve 340 in FIG. 3A) along a direction that is parallel to longitudinal axis 302 as indicated at 347. In other examples, valve face 343 may be convex or may be orthogonal to longitudinal axis 302. Elastomeric valve 340 interfaces with barrel 334 along an interface 380. Interface 380 is linear in this example, and is orthogonal to longitudinal axis 302. As an example, elastomeric valve 340 may be molded upon barrel 334.

As depicted in FIG. 3A, annular walls 341 of elastomeric valve 340 are compressed by wall surfaces of cap 350 onto wall surfaces of barrel 334 to form an annular seal indicated at 382. In this example, annular seal 382 is formed at least by compression of annular flange 349 of annular walls 341 by cap 350 onto barrel 334 primarily along a direction that is parallel to longitudinal axis 302 as indicated by force vectors 392. Annular flange 349 protrudes radially outwards from annular wall 341 of valve 340 at a base of the valve in this example, in contrast to annular flange 249 of FIG. 2A protruding radially outwards from annular wall 241 at an intermediate location of the valve as measured along the longitudinal axis.

Valve face 343 may include one or more slits formed therein that separates valve face 343 into two or more gate members. At least one such slit formed in valve face 343 may pass through longitudinal axis 302 and may extend outward from longitudinal axis 302 towards annular wall 341. When cap 350 is unthreaded and removed from barrel 334, deformation of elastomeric valve 340 by forces applied to exterior surfaces of elastomeric valve 340 (e.g., by a user's mouth, teeth, lips, etc.) may cause the slit to open in valve face 343 to thereby permit fluid to flow through and across the valve face. When cap 350 is threaded onto barrel 334, such deformation of elastomeric valve 340 may be precluded to thereby maintain the slit in valve face 343 in a closed state, and seal the elastomeric valve from fluid flow through or across the valve face.

Figure 3B:
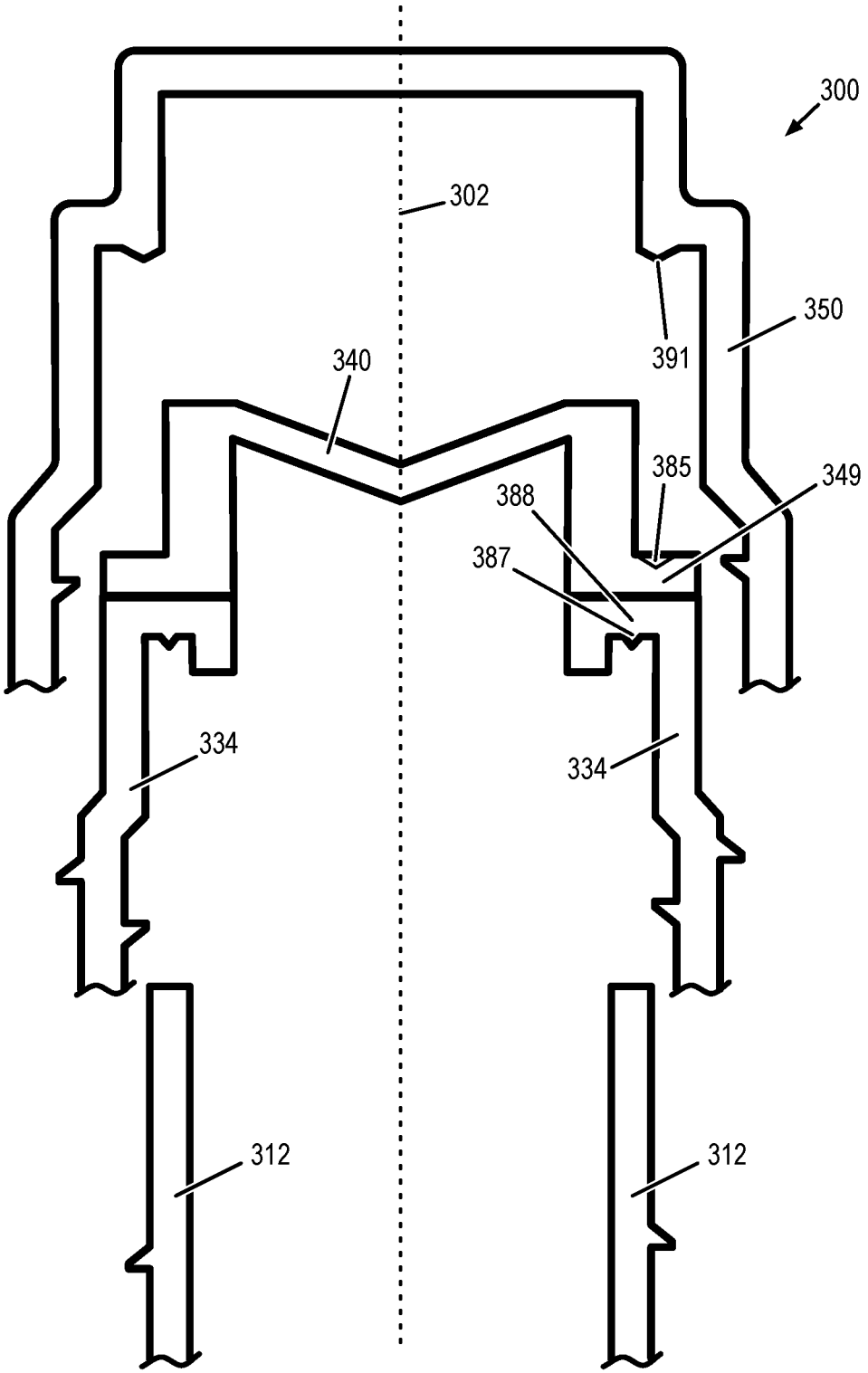
FIG. 3B depicts an exploded view of the valve system of FIG. 3A.

FIG. 3B depicts an exploded view of valve system 300, depicting elastomeric valve 340 in a non-compressed state relative to FIG. 3A. In this example, annular flange 349 includes an annular compression region 385. Annular compression region 385 is compressed downwards in a direction that is parallel to longitudinal axis 302 by wall surfaces that form annular protrusion 391 of an interior region of cap 350 to form annular seal 382 of FIG. 3A. Annular compression region 385 has an upper surface that is orthogonal to longitudinal axis 302 in this example. However, in other examples, annular compression region 385 may have another suitable shape.

Figure 4A:
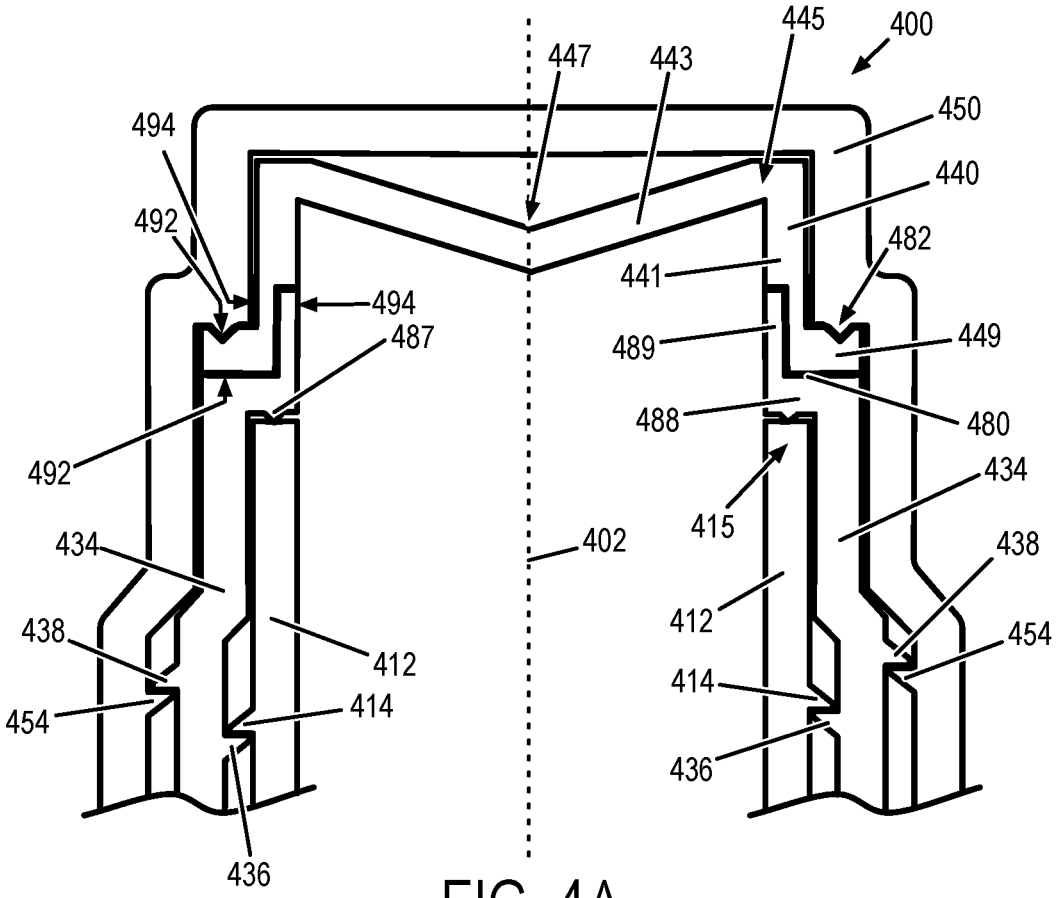
FIG. 4A depicts a section view of a third example valve system.

FIG. 4A depicts a section view of an example valve system 400 along a mid-plane that passes through and contains a longitudinal axis 402 of the valve system. The various components of valve system 400 may take the form of a solid or volume of revolution about longitudinal axis 402 in this example. Valve system 400 is a non-limiting example of previously described valve system 100 of FIG. 1A.

Valve system 400 includes a spout 412 (e.g., of a fitment or a container), a barrel 434 (e.g., of a sleeve), an elastomeric valve 440, and a cap 450. Valve system 400 provides another non-limiting example of an interface between the spout and the sleeve that may take the form of a rigid-on-rigid interface, at least for implementations in which the spout and sleeve are formed from rigid materials.

FIG. 4A depicts external threads 414 of spout 412 engaged in a fully threaded configuration with internal threads 436 of an interior region of barrel 434; and external threads 438 of barrel 434 engaged in a fully threaded configuration with internal threads 454 of an interior region of cap 450. In the example depicted in FIG. 4A, when these components are in a threaded or a fully threaded configuration with each other, portions of elastomeric valve 440 are compressed between cap 450 and barrel 434 along a first annular region, and portions of spout 412 and barrel 434 are compressed onto each other along a second annular region.

In this example, barrel 434 includes an annular flange 488 that protrudes radially inward towards the longitudinal axis of the barrel. A first annular surface of a terminal end of the spout contacts a second annular surface of annular flange 488 to form a seal 415 between the spout and the barrel of the sleeve. Within the context of the sleeve and the spout being formed from rigid materials, this seal may take the form of a rigid-on-rigid interface that is in contrast to the compliant-on-rigid interface between an elastomeric valve and the cap or spout.

In some examples, annular flange 488 may include an annular protrusion 487 that contacts the first annular surface of the spout. This annular protrusion 487 may take the form of an annular rib that is referred to as a crush rib within the context of a rigid-on-rigid interaction with the first annular surface of the spout. A crush rib and/or the opposing surface of the spout against which the crush rib is compressed may undergo plastic deformation in some examples.

Also in this example, elastomeric valve 440 includes an annular wall 441 and a valve face 443 that meet at a transition region 445. Valve face 443, in this example, is concave with respect to a terminal end of valve 440 (i.e., the upper surface of valve 440 in FIG. 4A) along a direction that is parallel to longitudinal axis 402 as indicated at 447. In other examples, valve face 443 may be convex or may be orthogonal to longitudinal axis 402. Elastomeric valve 440 interfaces with barrel 434 along an interface 480. Interface 480 is linear in this example, and is orthogonal to longitudinal axis 402. As an example, elastomeric valve 440 may be molded upon barrel 434.

As depicted in FIG. 4A, annular walls 441 of elastomeric valve 440 are compressed by wall surfaces of cap 450 onto wall surfaces of barrel 434 to form an annular seal indicated at 482. In this example, annular seal 482 is formed at least by compression of annular flange 449 of annular walls 441 by cap 450 onto barrel 434 along a direction that is parallel to longitudinal axis 402 as indicated by force vectors 492. Barrel 434 further includes an annular wall segment 489 that extends into an interior of elastomeric valve 440. Elastomeric valve 440 is also compressed radially outwards by wall surfaces of annular wall segment 489, optionally onto wall surfaces of an interior region of cap 450 along a direction that is primarily orthogonal to longitudinal axis 402 as indicated by force vectors 494.

Valve face 443 may include one or more slits formed therein that separates valve face 443 into two or more gate members. At least one such slit formed in valve face 443 may pass through longitudinal axis 402 and may extend outward from longitudinal axis 402 towards annular wall 441. When cap 450 is unthreaded and removed from barrel 434, deformation of elastomeric valve 440 by forces applied to exterior surfaces of elastomeric valve 440 (e.g., by a user's mouth, teeth, lips, etc.) may cause the slit to open in valve face 443 to thereby permit fluid to flow through and across the valve face. When cap 450 is threaded onto barrel 434, such deformation of elastomeric valve 440 may be precluded to thereby maintain the slit in valve face 443 in a closed state, and seal the elastomeric valve from fluid flow through or across the valve face.

Figure 4B:
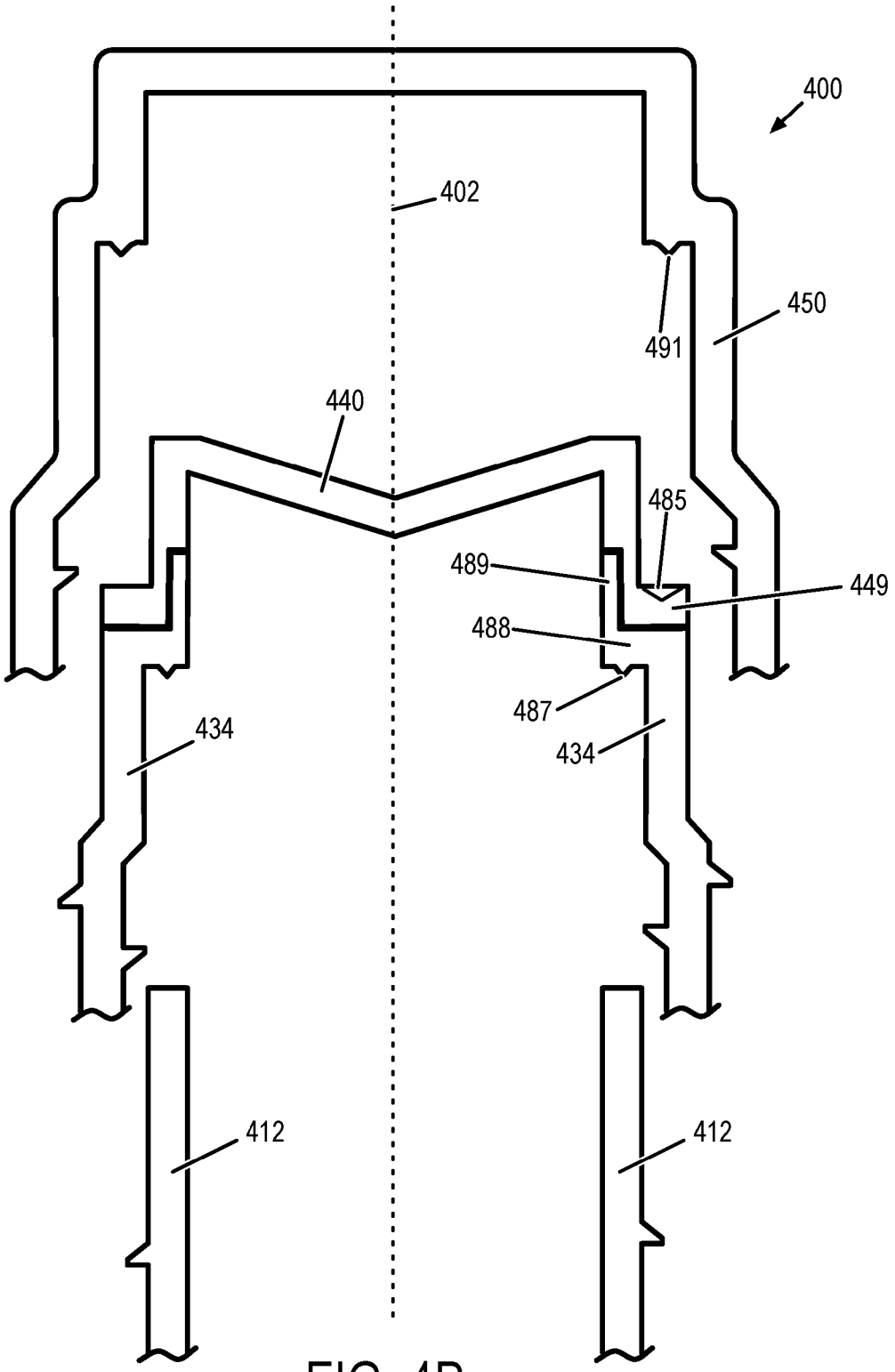
FIG. 4B depicts an exploded view of the valve system of FIG. 4A.

FIG. 4B depicts an exploded view of valve system 400, depicting elastomeric valve 440 in a non-compressed state relative to FIG. 4A. In this example, annular flange 449 includes an annular compression region 485. Annular compression region 485 is compressed downwards in a direction that is parallel to longitudinal axis 402 by annular wall surfaces that form annular protrusion 491 of an interior region of cap 450 to form annular seal 482 of FIG. 4A. Annular compression region 485 has an upper surface that is orthogonal to longitudinal axis 402 in this example. However, in other examples, annular compression region 485 may have another suitable shape. As previously described with reference to FIG. 4A, annular wall 441 of elastomeric valve 440 may also be compressed in a direction that is orthogonal to longitudinal axis 402 between wall surfaces of an interior region of cap 450 and annular wall segment 489 of barrel 434.

Figure 5A:
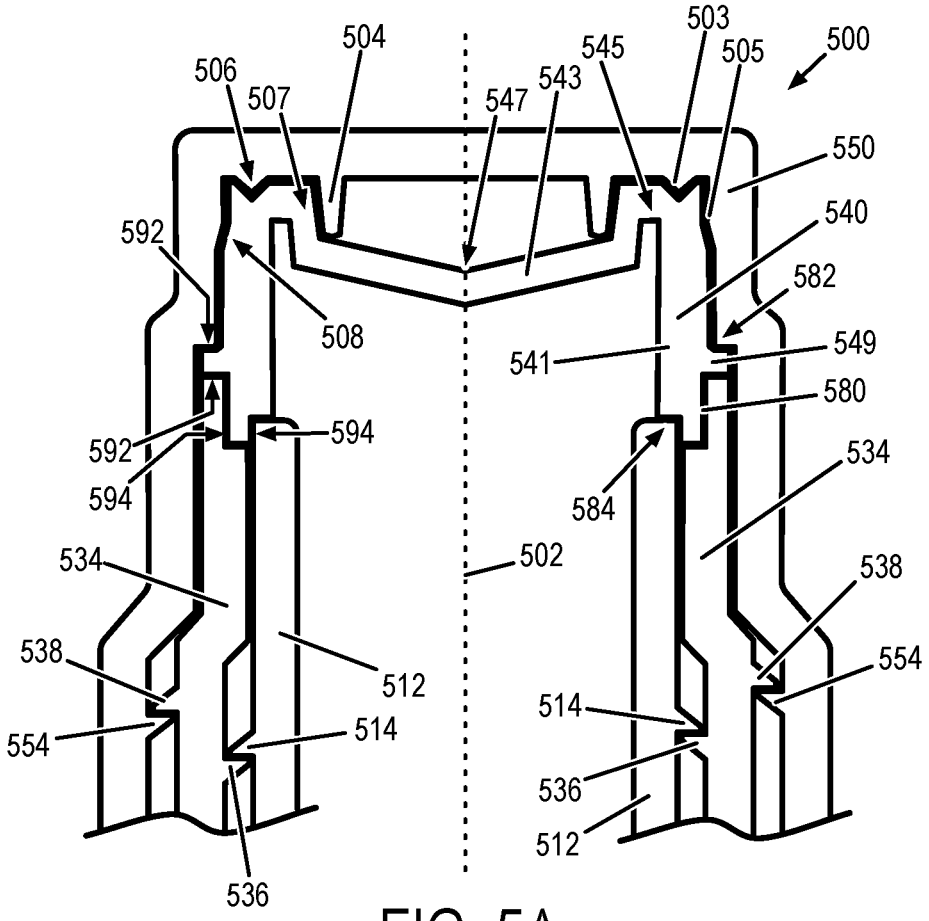
FIG. 5A depicts a section view of a fourth example valve system.

FIG. 5A depicts a section view of an example valve system 500 along a mid-plane that passes through and contains a longitudinal axis 502 of the valve system. The various components of valve system 500 may take the form of a solid or volume of revolution about longitudinal axis 502 in this example. Valve system 500 is a non-limiting example of previously described valve system 100 of FIG. 1A.

Valve system 500 is similar to valve system 200 of FIG. 2 in many respects, with the exception of the elastomeric valve structure and differences in a structure of the cap to provide additional compression regions for the elastomeric valve. Valve system 500 includes a spout 512 (e.g., of a fitment or a container), a barrel 534 (e.g., of a sleeve), an elastomeric valve 540, and a cap 550. FIG. 5A depicts external threads 514 of spout 512 engaged in a fully threaded configuration with internal threads 536 of an interior region of barrel 534; and external threads 538 of barrel 534 engaged in a fully threaded configuration with internal threads 554 of an interior region of cap 550. In the example depicted in FIG. 5A, when these components are in a threaded or a fully threaded configuration with each other, portions of elastomeric valve 540 are compressed between cap 550 and barrel 534 along a first annular region, and portions of the elastomeric valve are compressed between spout 512 and barrel 534 along a second annular region.

In this example, elastomeric valve 540 includes an annular wall 541 and a valve face 543 that meet at a transition region 545. Valve face 543, in this example, is concave with respect to a terminal end of valve 540 (i.e., the upper surface of valve 540 in FIG. 5A) along a direction that is parallel to longitudinal axis 502 as indicated at 547. In other examples, valve face 543 may be convex or may be orthogonal to longitudinal axis 502. Elastomeric valve 540 interfaces with barrel 534 along an interface 580. Interface 580 is non-linear in this example, and contains interface segments that are orientated at two or more orientations relative to longitudinal axis 502. As an example, elastomeric valve 540 may be molded upon barrel 534.

As depicted in FIG. 5A, annular walls 541 of elastomeric valve 540 are compressed by wall surfaces of cap 550 onto wall surfaces barrel 534 to form an annular seal indicated at 582. FIG. 5A also depicts annular walls 541 of elastomeric valve 540 compressed by wall surfaces of spout 512 onto wall surfaces of barrel 534 to form another annular seal indicated at 584. In this example, annular seal 582 is formed at least by compression of annular flange 549 of annular walls 541 by cap 550 onto barrel 534 primarily along a direction that is parallel to longitudinal axis 502 as indicated by force vectors 592, and annular seal 584 is formed at least by compression of a base of annular walls 541 by a terminal end of spout 512 onto barrel 534 primarily outward in an orthogonal direction from longitudinal axis 502 as indicated by force vectors 594.

As further depicted in FIG. 5A, elastomeric valve 540 is compressed at various locations by additional wall surfaces of cap 550 to provide additional annular seals beyond those previously described. For example, cap 550 includes annular protrusions 503, 504, and 505 within an interior region of the cap that contact and compresses portions of annular wall 541 and/or valve face 543 to provide annular seals 506, 507, and 508, respectively.

In this example, a rim of the valve contacts an annular surface (e.g., an annular protrusion 503) of an interior wall surface of the interior region of the cap to form a first annular seal 506 when the internal threads of the cap are fully threaded onto the external threads of the barrel. The annular surface of the cap may include an annular protrusion (e.g., 506 in FIG. 5A) that contacts the rim of the valve to compress and deform the rim of the valve in at least a longitudinal direction that is parallel to a longitudinal axis of the barrel. Annular protrusion 503 located at a terminal end of the interior region of the cap contacts and compresses a rim of elastomeric valve 540 in a downward direction that is primarily parallel to longitudinal axis 502 (e.g., in a counter-flow direction) to provide annular seal 506.

As previously described throughout the various examples, the valve may include a valve face that joins the annular wall of the valve and spans the second end of the barrel, opposite the first end of the barrel through which the spout is inserted. The valve face may be concave towards an interior of the barrel, for example. Annular protrusion 504 contacts and compresses valve face 543 of elastomeric valve 540 in a downward direction that is parallel to longitudinal axis 502 (e.g., in a counter-flow direction) and/or in an outward radial direction that is orthogonal to longitudinal axis 502 to form annular seal 507. Here, an interior wall surface of the interior region of the cap includes an annular protrusion (e.g., 504) that contacts the valve face when the internal threads of the cap are fully threaded onto the external threads of the barrel. The annular protrusion in this example compresses the valve face at least in an outward radial direction relative to a longitudinal axis of the barrel, and optionally downwards in a direction parallel to the longitudinal axis. Within the context of elastomeric valves, this compression in an outward radial direction may assist in maintaining the valve in a closed configuration. Annular protrusion 504 may further compress the valve face and/or the annular walls of the valve against other wall surfaces of the cap, such as wall surface 505, for example. Annular protrusion 505 contacts and compresses annular wall 541 of elastomeric valve 540 in an outward direction that is primarily orthogonal to longitudinal axis 502 to form annular seal 508.

Figure 5B:
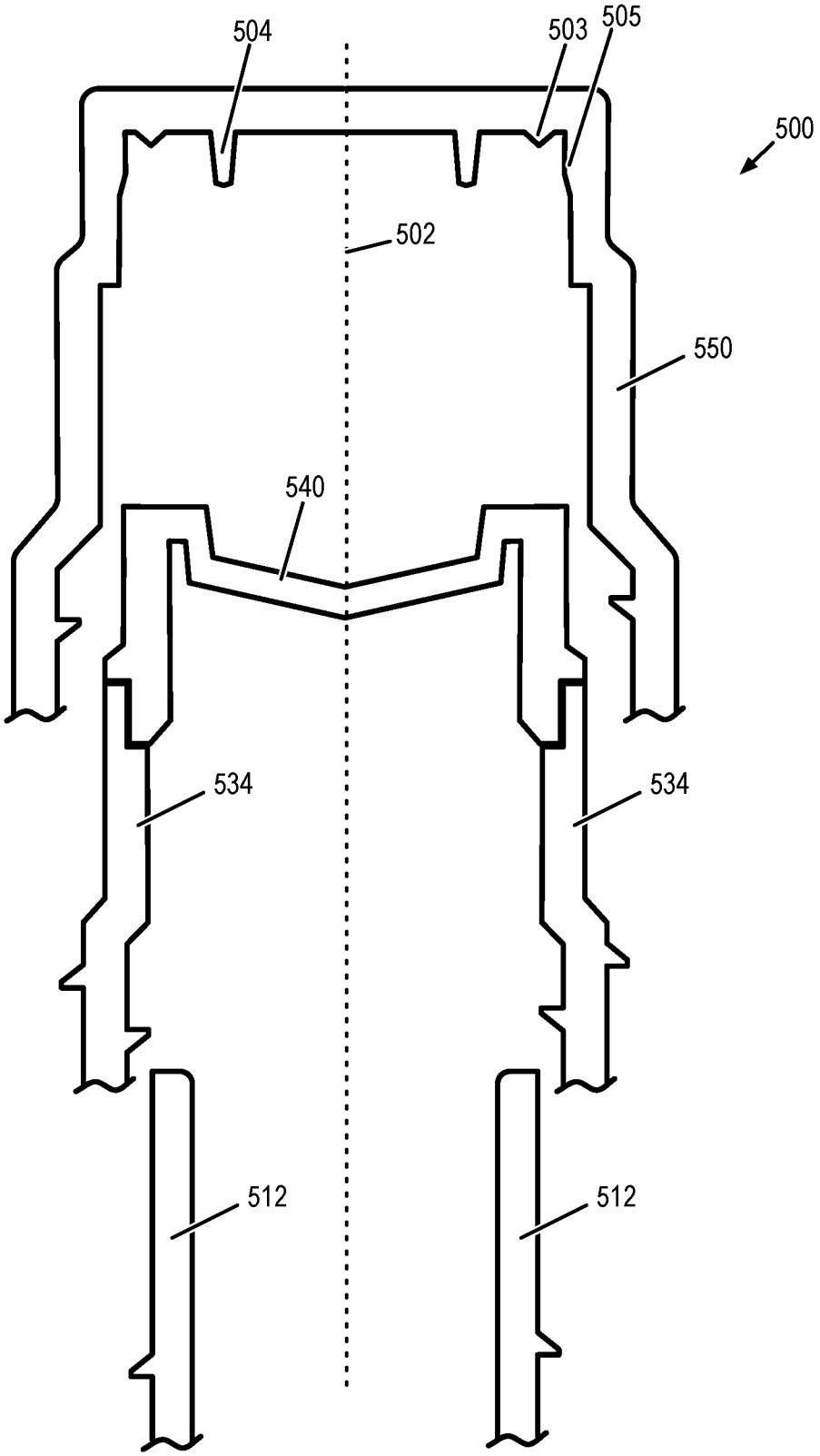
FIG. 5B depicts an exploded view of the valve system of FIG. 5A.

Valve face 543 may include one or more slits formed therein that separates valve face 543 into two or more gate members. At least one such slit formed in valve face 543 may pass through longitudinal axis 502 and may extend outward from longitudinal axis 502 towards annular wall 541. When cap 550 is unthreaded and removed from barrel 534, deformation of elastomeric valve 540 by forces applied to exterior surfaces of elastomeric valve 540 (e.g., by a user's mouth, teeth, lips, etc.) may cause the slit to open in valve face 543 to thereby permit fluid to flow through and across the valve face. When cap 550 is threaded onto barrel 534, such deformation of elastomeric valve 540 may be precluded to thereby maintain the slit in valve face 543 in a closed state, and seal the elastomeric valve from fluid flow through or across the valve face. FIG. 5B depicts an exploded view of valve system 500, depicting elastomeric valve 540 in a non-compressed state relative to FIG. 5A.

Figure 6:
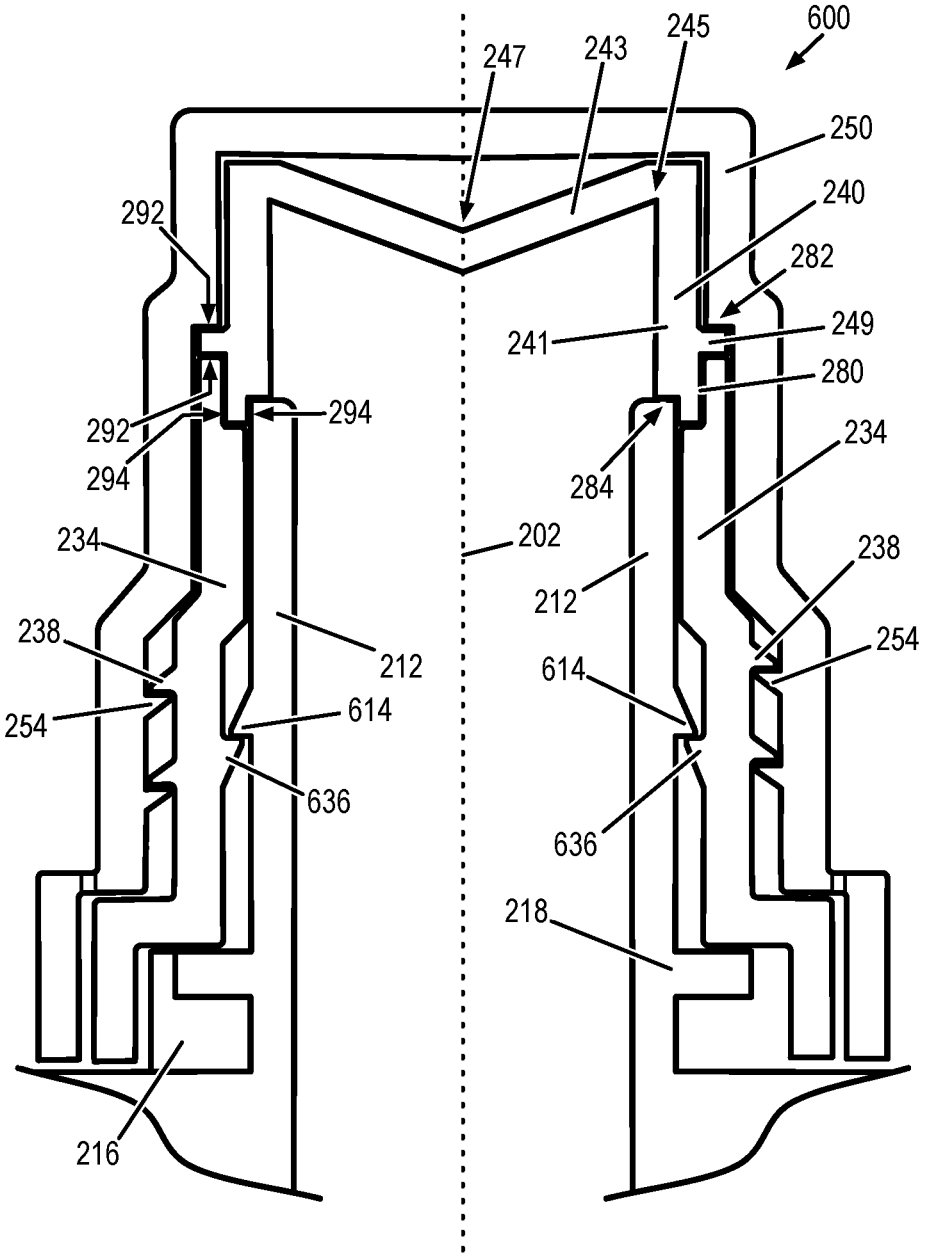
FIG. 6 depicts a section view of a fifth example valve system.

FIG. 6 depicts a section view of a fifth example valve system 600. For convenience, valve system 600 is depicted as having the same components and configuration as previously valve system 200 of FIGS. 2A and 2B, with the exception of the threaded interface between the spout and the sleeve of valve system 200 being replaced by a non-threaded interface in valve system 600. The various components of valve system 600 may take the form of a solid or volume of revolution about longitudinal axis 202 in this example, with the exception of catch 216 and the threads that change pitch with angular rotation about longitudinal axis 202. Valve system 600 is a non-limiting example of previously described valve system 100 of FIG. 1A.

In this example, the non-threaded interface between spout 212 and sleeve 234 takes the form of a snap-fit interface. This snap-fit interface is another example of a non-removable interface between the spout and the sleeve. A non-limiting example of a snap-fit interface is depicted in FIG. 6 in which spout 212 includes an annular rib 614 that protrudes radially outwards from an exterior wall of the spout, and sleeve 234 includes an annular rib 636 that protrudes radially inwards from an interior wall of the barrel of the sleeve. Annular ribs 614 and 636 may include opposing inclined surfaces that enable the annular ribs to slide over and past each other along the longitudinal axis upon an initial insertion of the spout into the sleeve. This process of the annular ribs sliding over and past each other may include temporary or even permanent deformation of the sleeve and/or spout to provide a non-removable interface.

In FIG. 6, an upper surface of annular rib 614 takes the form of a first inclined surface, and a lower surface of annular rib 636 takes the form of a second inclined surface that opposes the first inclined surface. Annular ribs 614 and 636 may further include opposing engagement surfaces that are less inclined relative to each other (e.g., closer to being orthogonal to the longitudinal axis) to form an annular catch. These opposing engagement surfaces interfere with each other to inhibit removal of the spout from the sleeve. In FIG. 6, a lower surface of annular rib 614 takes the form of a first opposing engagement surface and an upper surface of annular rib 636 takes the form of a second opposing engagement surface.

Figure 7A:
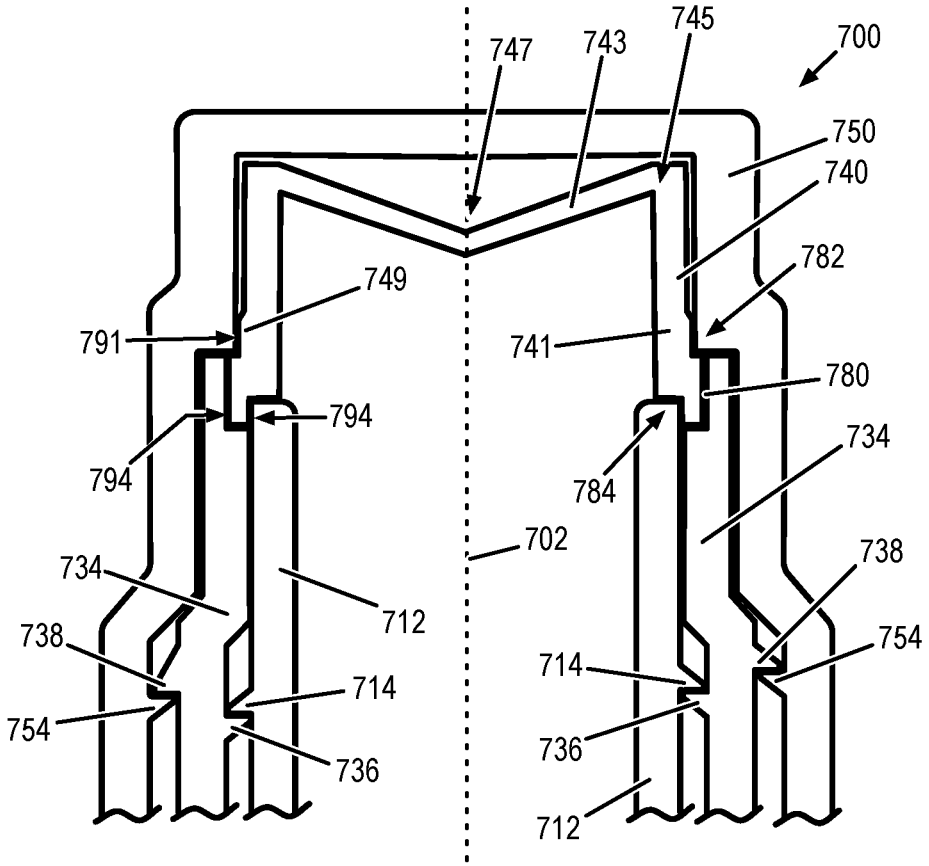
FIG. 7A depicts a sixth example valve system.

FIG. 7A depicts a section view of an example valve system 700 along a mid-plane that passes through and contains a longitudinal axis 702 of the valve system. The various components of valve system 700 may take the form of a solid or volume of revolution about longitudinal axis 702 in this example. Valve system 700 is a non-limiting example of previously described valve system 100 of FIG. 1A.

Valve system 700 is similar to valve system 200 in many respects, with the exception that the annular flange of the valve in valve system 200 instead takes the form of a bulge and/or taper of an exterior surface of annular wall 741 of the valve in valve system 700 that creates compression radially inwards towards the longitudinal axis when contacted by the cap to form an annular seal. In this example, the bulge or taper of the exterior surface at a lower end of the annular wall of the valve as compared to an upper end of the valve that interfaces with the valve face is compressed by the cap when fully threaded onto the sleeve. Here, the exterior surface of the annular wall of the valve tapers inwards towards the longitudinal axis as the annular wall extends upwards towards the valve face.

Valve system 700 includes a spout 712 (e.g., of a fitment or a container), a barrel 734 (e.g., of a sleeve), an elastomeric valve 740, and a cap 750. FIG. 7A depicts external threads 714 of spout 712 engaged in a fully threaded configuration with internal threads 736 of an interior region of barrel 734; and external threads 738 of barrel 734 engaged in a fully threaded configuration with internal threads 754 of an interior region of cap 750. In the example depicted in FIG. 7A, when these components are in a threaded onto each other or are in a fully threaded configuration with each other, portions of elastomeric valve 740 are compressed radially inwards toward the longitudinal axis along a first annular region by wall surfaces of cap 750 as indicated by force vector 791, and portions of the elastomeric valve are compressed between wall surfaces of spout 712 and wall surfaces of barrel 734 along a second annular region as indicated by force vectors 794.

In this example, elastomeric valve 740 includes an annular wall 741 and a valve face 743 that meet at a transition region 745. Transition region 745 may take the form of a hinge for gate elements of valve face 743 in some examples. Valve face 743, in this example, is concave with respect to a terminal end of valve 740 (i.e., the upper surface of valve 740 in FIG. 7A) along a direction that is parallel to longitudinal axis 702 as indicated at 747. In other examples, valve face 743 may be convex or may be flat (e.g., orthogonal to longitudinal axis 702).

Elastomeric valve 740 interfaces with barrel 734 along an interface 780. Interface 780 is non-linear in this example, and contains interface segments that are orientated at two or more different orientations relative to longitudinal axis 702. As an example, elastomeric valve 740 may be molded upon barrel 734.

As depicted in FIG. 7A, annular walls 741 of elastomeric valve 740 are contacted and compressed radially inwards towards longitudinal axis 702 by wall surfaces of cap 750 to form an annular seal indicated at 782. FIG. 7A also depicts annular walls 741 of elastomeric valve 740 compressed by wall surfaces of spout 712 onto wall surfaces of barrel 734 to form another annular seal indicated at 784. In this example, annular seal 782 is formed at least by compression of annular bulge portion 749 by cap 750 onto barrel 734 primarily along an inward radial direction that is orthogonal to longitudinal axis 702 as indicated by force vectors 792, and annular seal 784 is formed at least by compression of a base of annular walls 741 by a terminal end of spout 712 onto barrel 734 primarily outward in an orthogonal direction from longitudinal axis 702 as indicated by force vectors 794. Annular bulge portion 749 protrudes radially outwards from annular walls 741 at an intermediate location along a longitudinal axis of the valve. Additionally, within this example, compression provided at 782 and 784 by the cap and spout may be towards each other to further compress the valve between wall surfaces of the cap and spout.

Valve face 743 may include one or more slits formed therein that separates valve face 743 into two or more gate members. At least one such slit formed in valve face 743 may pass through longitudinal axis 702 and may extend outward from longitudinal axis 702 towards annular wall 741. When cap 750 is unthreaded and removed from barrel 734, deformation of elastomeric valve 740 by forces applied to exterior surfaces of elastomeric valve 740 (e.g., by a user's mouth, teeth, lips, etc.) may cause the slit to open in valve face 743 to thereby permit fluid to flow through and across the valve face. When cap 750 is threaded onto barrel 734, such deformation of elastomeric valve 740 may be precluded to thereby maintain the slit in valve face 743 in a closed state, and seal the elastomeric valve from fluid flow through or across the valve face.

Figure 7B:
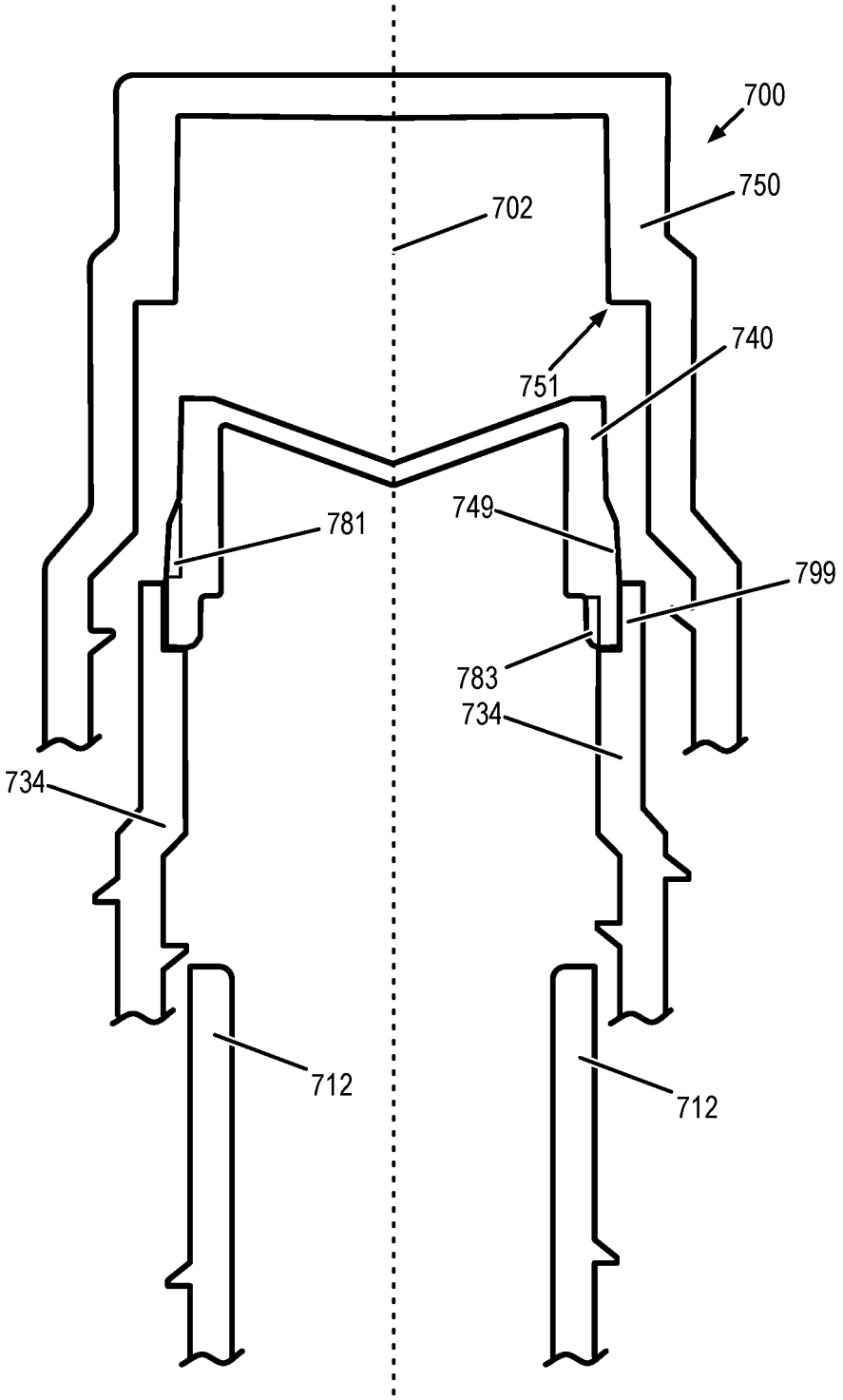
FIG. 7B depicts an exploded view of the sixth example valve system of FIG. 7A.

FIG. 7B depicts an exploded view of valve system 700, depicting elastomeric valve 740 in a non-compressed state relative to FIG. 7A. In this example, annular bulge portion 749 includes an annular compression region 781. Annular compression region 781 is compressed downwards in a direction that is parallel to longitudinal axis 702 and/or radially inwards in a direction that is orthogonal to the longitudinal axis by wall surfaces 751 of an interior region of cap 750 to form annular seal 782 of FIG. 7A. Annular compression region 781 has an upper surface that tapers from annular walls 741 towards a terminal end or outer edge of annular bulge portion 749 in this example. However, in other examples, annular compression region 781 may have another suitable shape. Also in this example, an annular compression region 783 formed at a base of valve 740 is compressed upwards and radially outwards against the barrel by a terminal end of spout 712 to form annular seal 784. Here, the annular wall of the valve is compressed radially outwards against a wall segment 799 of the barrel that overlaps with the valve, as indicated by force vectors 794.

Figure 8A:
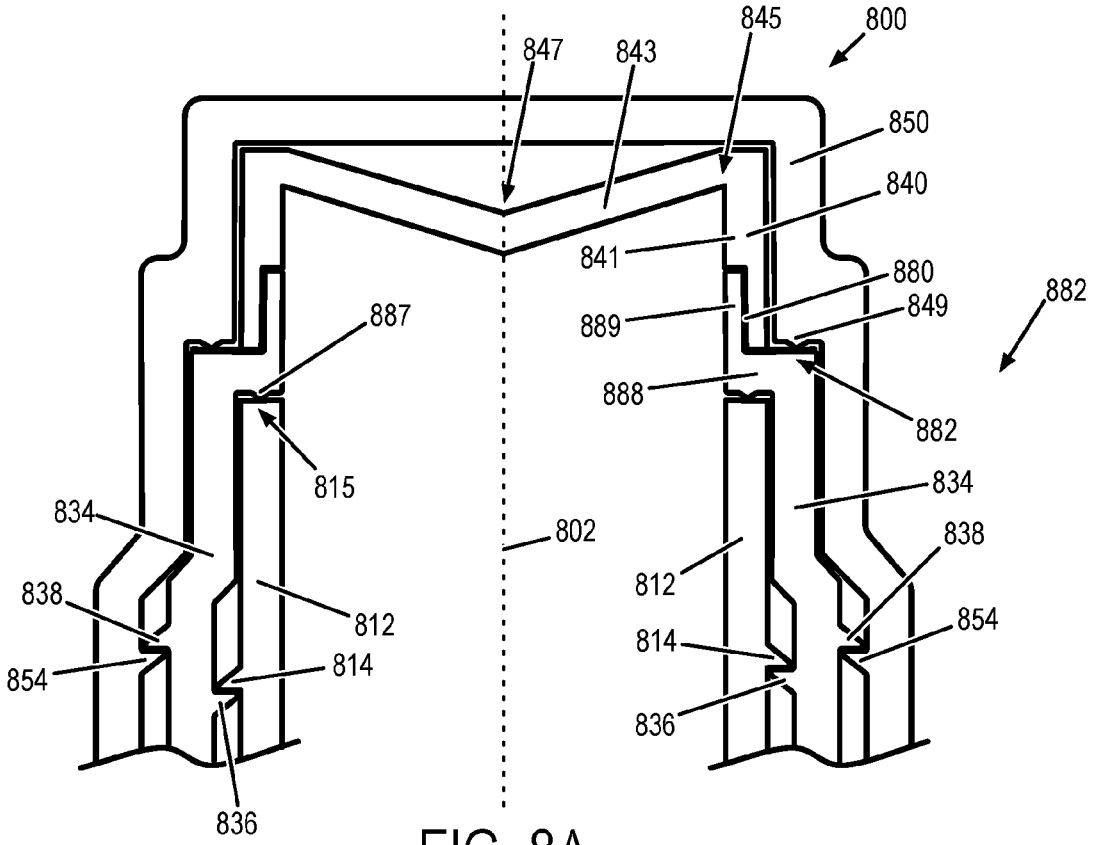
FIG. 8A depicts a seventh example valve system.
Figure 8B:
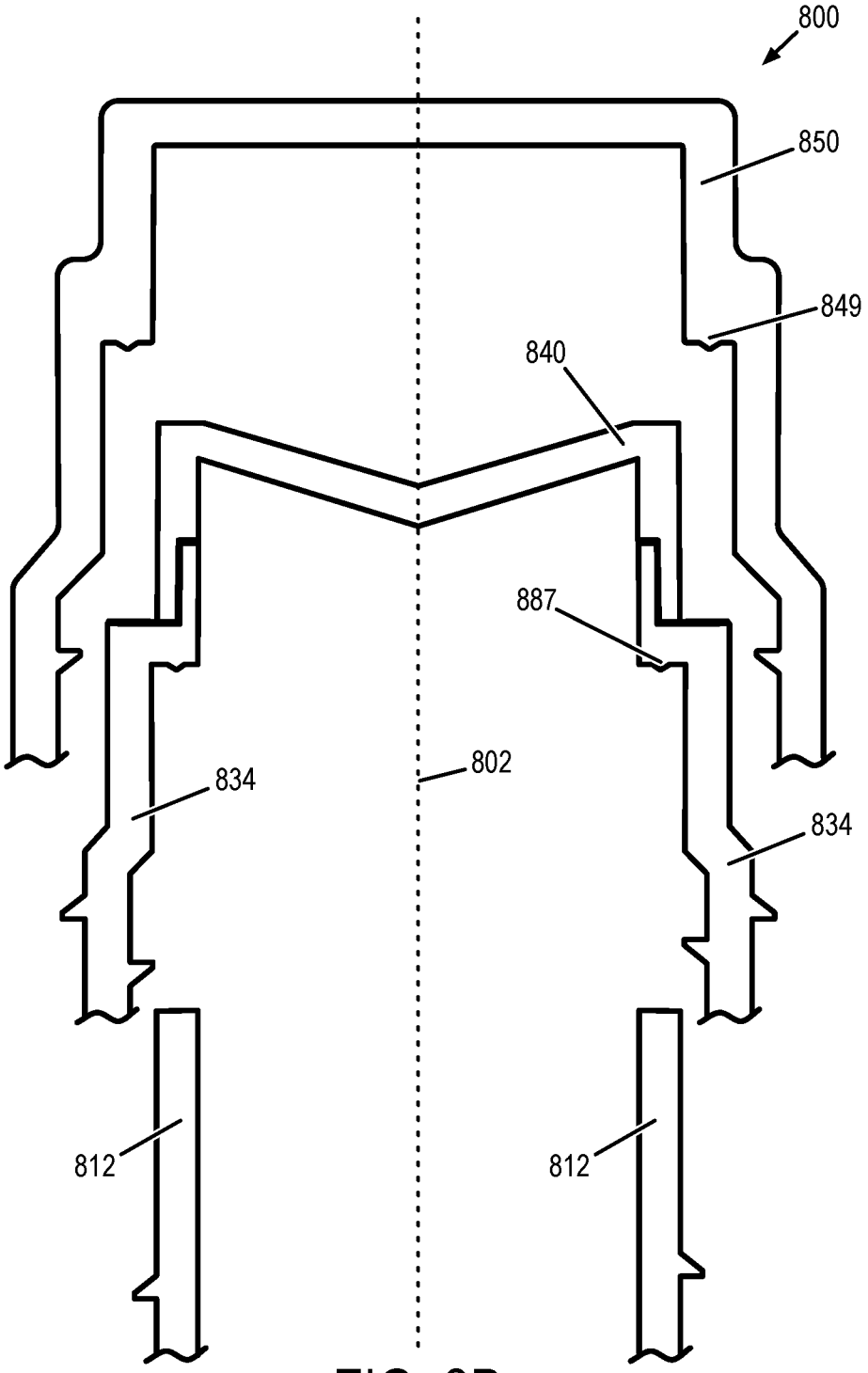
FIG. 8B depicts an exploded view of the seventh example valve system of FIG. 8A.

FIG. 8A depicts a section view of an example valve system 800 along a mid-plane that passes through and contains a longitudinal axis 802 of the valve system. The various components of valve system 800 may take the form of a solid or volume of revolution about longitudinal axis 802 in this example. Valve system 800 is a non-limiting example of previously described valve system 100 of FIG. 1A. FIG. 8B depicts an exploded view of valve system 800.

Valve system 800 includes a spout 812 (e.g., of a fitment or a container), a barrel 834 (e.g., of a sleeve), an elastomeric valve 840, and a cap 850. Valve system 800 provides another non-limiting example of an annular interface (e.g., forming an annular seal 815) between the spout and the sleeve that may take the form of a rigid-on-rigid interface, at least for implementations in which the spout and sleeve are formed from rigid materials. Valve system 800 further provides a non-limiting example of an annular interface (e.g., forming an annular seal 882) between the cap and the sleeve that may take the form of a rigid-on-rigid interface, at least for implementations in which the cap and sleeve are formed from rigid materials.

FIG. 8A depicts external threads 814 of spout 812 engaged in a fully threaded configuration with internal threads 836 of an interior region of barrel 834; and external threads 838 of barrel 834 engaged in a fully threaded configuration with internal threads 854 of an interior region of cap 850. In the example depicted in FIG. 8A, when these components are in a threaded or a fully threaded configuration with each other, elastomeric valve 840 may or may not be compressed between cap 850 and barrel 834, depending on implementation. However, in this example, portions of spout 812 and barrel 834 are compressed onto each other, primarily in a longitudinal direction that is parallel to longitudinal axis 802, along an annular interface that forms annular seal 815, and portions of cap 850 and barrel 834 are compressed onto each other, primarily in a longitudinal direction that is parallel to longitudinal axis 802, along an annular interface to form annular seal 882.

In this example, barrel 834 includes an annular flange 888 that protrudes radially inward towards the longitudinal axis of the barrel. A first annular surface of a terminal end of the spout contacts a second annular surface of annular flange 888 to form annular seal 815 between the spout and the barrel of the sleeve. Within the context of the sleeve and the spout being formed from rigid materials, this seal may take the form of a rigid-on-rigid interface that is in contrast to the compliant-on-rigid interface between an elastomeric valve and the cap or spout.

In some examples, annular flange 888 may include an annular protrusion 887 that contacts the annular surface at a terminal end of the spout. This annular protrusion 887 may take the form of an annular rib that is referred to as a crush rib within the context of a rigid-on-rigid interaction with the annular surface at a terminal end of the spout. A crush rib and/or the opposing surface of the spout against which the crush rib is compressed may undergo plastic deformation in some examples. Alternatively, an annular surface of the terminal end of the spout may include an annular protrusion that contacts the annular surface of annular flange 888 of the barrel.

Also in this example, elastomeric valve 840 includes an annular wall 841 and a valve face 843 that meet at a transition region 845. Valve face 843, in this example, is concave towards the barrel with respect to a terminal end of valve 840 (i.e., the upper surface of valve 840 in FIG. 8A) along a direction that is parallel to longitudinal axis 802 as indicated at 847. In other examples, valve face 843 may be convex or may be orthogonal to longitudinal axis 802. Elastomeric valve 840 interfaces with barrel 834 along an interface 880. Interface 880 is non-linear in this example, and is orthogonal to longitudinal axis 802. As an example, elastomeric valve 840 may be molded upon barrel 834.

In contrast to other examples described and depicted herein, elastomeric valve 840 is not necessarily contacted or compressed by wall surfaces of the cap or the spout. However, within the context of valve system 800 or other rigid-on-rigid interfaces between the cap and the sleeve, the cap may contact and/or compress the elastomeric valve along an annular wall of the valve, an annular rim of the valve, and/or the valve face, depending on implementation. As a non-limiting example, the cap may contact and/or compressed the annular wall of the valve radially inward towards the longitudinal axis and/or onto the wall segment 889 of barrel 834. In other examples, wall segment 889 may be omitted from barrel 834.

Valve face 843 may include one or more slits formed therein that separates valve face 843 into two or more gate members. At least one such slit formed in valve face 843 may pass through longitudinal axis 802 and may extend outward from longitudinal axis 802 towards annular wall 841. When cap 850 is unthreaded and removed from barrel 834, deformation of elastomeric valve 840 by forces applied to exterior surfaces of elastomeric valve 840 (e.g., by a user's mouth, teeth, lips, etc.) may cause the slit to open in valve face 843 to thereby permit fluid to flow through and across the valve face. When cap 850 is threaded onto barrel 834, such deformation of elastomeric valve 840 may be precluded to thereby maintain the slit in valve face 843 in a closed state, and seal the elastomeric valve from fluid flow through or across the valve face.

In view of the various example valve systems of FIGS. 1-6, a valve includes an annular flange that protrudes outward from an annular wall of the valve. FIG. 7 depicts an example in which the annular flange takes the form of an annular bulge region on an exterior of the valve. The annular flange in at least some of these examples is compressed between a first annular surface of the barrel of the sleeve and a second annular surface of an interior wall surface of the interior region of the cap in at least a longitudinal direction that is parallel to a longitudinal axis of the barrel of the sleeve to form a first annular seal when the internal threads of the cap are fully threaded onto the external threads of the barrel. In at least some example, such as depicted in FIGS. 3A and 4A, the second annular surface of the interior region of the cap includes an annular protrusion that contacts the annular flange of the valve to compress and deform the annular flange towards the first annular surface of the barrel of the sleeve.

In at least some examples, such as in FIGS. 2A, 5A, and 6, a third annular surface of a terminal end of the spout contacts an annular wall portion of the annular wall of the valve to form a second annular seal when the internal threads of the barrel are fully threaded onto the external threads of the spout. Here, the annular wall portion of the valve is compressed between the third annular surface of the spout and a fourth annular surface of an interior region of the barrel of the sleeve in at least a radial direction that is orthogonal to the longitudinal direction when the internal threads of the barrel are fully threaded onto the external threads of the spout.

In at least some examples, such as in FIG. 4A, the annular flange of the valve surrounds the barrel at the second end of the barrel (opposite the first end of the barrel through which the spout is inserted) and the third annular surface of the sleeve contacts a fourth annular surface of an interior wall surface of the annular wall of the valve to form a second annular seal when the internal threads of the barrel are fully threaded onto the external threads of the spout.

As previously described with reference to FIGS. 2 and 5, in at least some implementations, exterior wall surfaces of the spout contact the elastomeric valve when the internal threads of the barrel are fully threaded onto the external threads of the spout. As an example, the exterior wall surfaces of the sleeve contact the elastomeric valve along an annular region of the elastomeric valve that is backed by an annular portion of the sleeve in the configurations depicted in FIG. 2A. In this example, the exterior wall surfaces of the spout compress the annular region of the elastomeric valve between and onto the annular portion of the sleeve in the horizontal direction (e.g., relative to a longitudinal axis of the fluid pathway) to provide a food grade seal and/or an FDA-compliant seal. As previously described, food grade and/or FDA-compliant seals may be achieved by a relatively high compression of the elastomeric valve, and may even provide a seal that exceeds a bursting pressure of the fluid container. In other configurations, exterior wall surfaces of the spout do not contact any portion of the elastomeric valve when the internal threads of the barrel are fully threaded onto the external threads of the spout.

In at least some implementations, an annular region of the elastomeric valve may include an annular channel formed in exterior wall surfaces of the elastomeric valve, and the wall surfaces of the interior region of the cap (or alternatively an exterior region of the spout) that contacts the elastomeric valve includes an annular ridge that accommodates the annular channel of the elastomeric valve. In at least some implementations, an annular region of the elastomeric valve includes an annular ridge formed in exterior wall surfaces of the elastomeric valve, and the wall surfaces of the interior region of the cap (or alternatively an exterior region of the spout) that contacts the elastomeric valve includes an annular channel that accommodates the annular ridge of the elastomeric valve. In at least some implementations, the annular region of the elastomeric valve does not include an annular channel or ridge formed in exterior wall surfaces of the elastomeric valve, and the wall surfaces of the interior region of the cap (or alternatively an exterior region of the spout) that contacts the elastomeric valve includes an annular ridge or an annular channel that causes engages the elastomeric valve when compressed. An annular ridge and/or channel may increase surface area of a seal and/or may reduce lateral movement or deformation of the elastomeric valve relative to the sleeve.

In at least some implementations, the various elastomeric valves described herein include two or more gate elements formed by a slit in a valve face. These two or more gate elements collectively block the internal fluid pathway to close the internal fluid pathway and deform to provide a valve opening through which a fluid may flow. The cap and/or spout may contact the elastomeric valve at other suitable locations than those previously described herein.

Furthermore, interior wall surfaces of a terminal end (e.g., inside top surfaces) of interior region of the cap may contact the elastomeric valve at a rim of the valve surrounding the gate elements and/or may directly contact the gate elements, for example, as depicted in FIG. 5A.

The two or more gate elements may form a concave gate assembly relative to the second end of the barrel (e.g., as depicted in FIGS. 2-8). In these examples, the annular region of the elastomeric valve may be located along exterior wall surfaces of the elastomeric valve that radially surround the two or more gate elements and may be closer to the first end of the barrel than the two or more gate elements as measured along a longitudinal axis of the valve assembly. In at least some implementations, the elastomeric valve does not contact the cap at any other region of the elastomeric valve outside of the annular region that is backed by an annular portion of the sleeve. Additionally or alternatively, the cap may not contact the elastomeric valve at the valve face, rim, or along the annular wall near the interface with the valve face, such as depicted in FIGS. 2, 3, 6, and 8, for example. This approach reduces or eliminates deformation of the elastomeric valve when the cap is threaded or fully threaded onto the sleeve to thereby reduce or eliminate fluid leakage through the valve's gate elements. As another example, the two or more gate elements of an elastomeric valve form a flat or convex gate assembly relative to the second end of the barrel. In this example, the wall surfaces of the interior region of the cap may contact the elastomeric valve at the two or more gate elements to resist deformation of the gate elements and seal the gate assembly.

In at least some implementations, the elastomeric valve may include angled surfaces that are compressed by the more rigid cap or spout. In FIG. 2A, the angled surfaces may be located at a transition to an annular flange of the valve (e.g., where the cap contacts the valve), and at a lower rim of the valve (e.g., where the spout contacts the valve). Additionally or alternatively, rigid to rigid seals may be achieved between the cap and sleeve and/or between the sleeve and the spout and/or between the cap and the fitment at various annular regions or locations. In these examples, a crushed rim interface may be used between the cap and sleeve and/or between the spout and sleeve (e.g., as depicted in FIGS. 3 and 4).

In addition to the annular seals formed by compression of an elastomeric valve via a compliant-to-rigid interface or the rigid-to-rigid interface by way of a crush rib, an annular seal may be formed in any of the examples disclosed herein between an interior surface of the barrel and an exterior surface of the spout by an inner diameter of the barrel being slightly smaller than an outer diameter of the spout before insertion of the spout into the barrel. This oversized spout and undersized barrel creates radial compression when assembled to form an additional annular seal.

In the example depicted in FIG. 2A, the valve may include a relatively large inside diameter (e.g., 7.4-9.6 mm) that corresponds with an appropriate size for use by children with comparably sized spouts. By contrast, for the same sized spout, the example of FIG. 3A may include a relatively smaller valve diameter (e.g., 4.5-7.0 mm) to fit inside a traditional or typical spout diameter, which may not provide sufficient flow for certain applications. In the example of FIG. 4A, the valve diameter may be of intermediate size (e.g., 6.1-8.5 mm) for the same sized spout. It will be understood that the above dimensions are provided as non-limiting examples, and that a valve may be suitably sized for other implementations and may take other suitable forms.

In at least some implementations, the cap includes a tamper-evident band or ring (e.g., 156 in FIG. 1A) that surrounds an opening of the interior region of the cap that includes at least a first tamper-evident catch (e.g., 158 in FIG. 1A), and the sleeve includes at least a second tamper-evident catch (e.g., 146 in FIG. 1A) formed along an exterior of the barrel or collar of the sleeve that engages the first tamper-evident catch. As an example, the second tamper-evident catch may protrude from collar or flange of the barrel. The first tamper-evident catch of the tamper evident band engages the second tamper-evident catch when the internal threads of the cap are initially threaded onto the external threads of the barrel, such as during manufacturing or filling of the fluid container. The second tamper-evident catch damages or otherwise physically alters one or more tamper-evident elements that initially retain and connect the tamper-evident band to the cap due to a subsequent unthreading of the internal threads of the cap from the external threads of the barrel to provide a visual indication to the consumer.

The various valve system components described herein may be formed from a variety of different polymers or other suitable materials. As an example, the fitment may be formed from a rigid polyethylene, the sleeve may be formed from a rigid polypropylene, and the valve may be formed from a deformable thermoplastic elastomer (TPE), silicon rubber, or other suitable elastomer or combination of elastomers (in the case of an elastomeric valve). The cap may be formed from a rigid polyethylene or rigid polypropylene, for example. As another example, the sleeve and valve may be formed from polypropylene (in the case of a push/pull valve or other mechanical valve). A valve assembly that is formed from two different materials, such as a polypropylene sleeve and a thermoplastic elastomer valve may be produced by double-shot molding, for example.

FIG. 2A depicts an example in which fluid passing through the internal fluid pathway of the valve assembly does not contact the sleeve. Here, fluid passes directly from the spout to the valve without contacting the sleeve. In this example, the sleeve may be formed from a non-food grade or non-FDA compliant material. FIGS. 3A and 4A depict examples in which fluid passing through the internal fluid pathway of the valve assembly contacts the sleeve. In these examples, the sleeve may be typically formed from a food grade or FDA-compliant material, along with the spout, valve and/or cap.

While examples of internal and external threads are described herein and depicted in the drawings, in other configurations, the external threads disclosed herein may be replaced by internal threads, and the internal threads disclosed herein may be replaced by external threads. In still other examples, one or more of the threaded interfaces may be replaced by a press-fit interface, a snap-fit interface, and/or heat sealing or other forms of bonding. For example, the sleeve may be press fit, snap fit, or bonded into an opening of the fitment or fluid container in a manner that precludes or alternatively allows removal of the sleeve from the fitment, and/or the cap may be press fit onto the valve assembly in a manner that allows removal of the cap by the consumer.

The valve system disclosed herein may provide significant manufacturing and cost benefits when incorporated with a drink pouch commonly used to package juices and purees. The filling process for drink and puree pouches is well established in the food packaging industry. This process is highly automated and the equipment is expensive both to purchase and to modify. There are a number of co-packers and food companies who own such equipment and it's of great benefit to them to maximize the number of different products that they can run on a given machine and to minimize the cost and time to modify the machines for a new product and any change-over cost and time to convert from one product to another.

In an example, filling equipment may assemble the valve systems disclosed herein and integrate the valve systems disclosed herein with a pouch by: (1) the preassembled pouches with spouts are loaded onto a transport rail, (2) the rail delivers the pouch to the fill station, (3) the filling head moves down and seals against the top of the spout then the product is pumped into the pouch at high speed and pressure, (4) the head retracts, (5) the filled pouch is transported to the next station that cleans the spout with a jet of air, (6) at the next station, a vibrating bowl delivers the valve assembly with pre-threaded cap, and drops it onto the top of the spout, (7) the pouch assembly advances to the next station in which a "fork" moves down engaging the thread assembly and/or cap and rotates the thread assembly and pre-threaded cap onto the spout, (8) as the thread assembly screws into the spout, the sleeve locks into place with a latching detail (e.g., a locking catch) between the sleeve and the spout. The phrase "pre-threaded" cap is used herein to refer to an assembled combination of the valve assembly with a cap threaded onto or into the valve assembly.

The drawings accompanying this disclosure include schematic representations of valve system configurations. These drawings are not necessarily to scale, but may be relied upon as scale drawings to provide example configurations. The various examples disclosed herein include features (e.g., annular protrusions and/or compression regions) that may be used individually or in any combination among the various examples and configurations disclosed herein. Claimed subject matter is not limited to the combination of features disclosed by an individual example, since features that are present in two or more of the disclosed examples may be used together in any suitable combination. Accordingly, it should be understood that the disclosed examples are illustrative and not restrictive. Variations to the disclosed examples that fall within the metes and bounds of the claims or equivalence of such metes and bounds are intended to be embraced by the claims.

The invention claimed is:

1. A valve system, comprising:

a spout of a fluid container or a fitment for a fluid container, the spout having external threads;

a valve assembly including:

a sleeve forming a barrel that accommodates the spout within a first end of the barrel, the barrel including internal threads and external threads, the internal threads of the barrel engaging with the external threads of the spout, and an elastomeric valve located at a second end of the barrel, the elastomeric valve operable to open and close an internal fluid pathway of the valve assembly; and a cap defining an interior region that includes internal threads that engage with the external threads of the barrel, the cap accommodating the elastomeric valve within the interior region when the internal threads of the cap are fully threaded onto the external threads of the barrel.

2. The valve system of claim 1, wherein the elastomeric valve includes an annular flange that protrudes outward from an annular wall of the elastomeric valve; and wherein the annular flange is compressed between a first annular surface of the barrel of the sleeve and a second annular surface of an interior wall surface of the interior region of the cap in at least a longitudinal direction that is parallel to a longitudinal axis of the barrel of the sleeve to form a first annular seal when the internal threads of the cap are fully threaded onto the external threads of the barrel.

3. The valve system of claim 2, wherein a third annular surface of a terminal end of the spout contacts an annular wall portion of the annular wall of the elastomeric valve to form a second annular seal when the internal threads of the barrel are fully threaded onto the external threads of the spout.

4. The valve system of claim 3, wherein the annular wall portion of the elastomeric valve is compressed between the third annular surface of the spout and a fourth annular surface of an interior region of the barrel of the sleeve in at least a radial direction that is orthogonal to the longitudinal direction when the internal threads of the barrel are fully threaded onto the external threads of the spout.

5. The valve system of claim 2, wherein the annular flange of the elastomeric valve surrounds the barrel at the second end of the barrel; and wherein the third annular surface of the sleeve contacts a fourth annular surface of an interior wall surface of the annular wall of the elastomeric valve to form a second annular seal when the internal threads of the barrel are fully threaded onto the external threads of the spout.

6. The valve system of claim 2, wherein the second annular surface of the interior region of the cap includes an annular protrusion that contacts the annular flange of the elastomeric valve to compress and deform the annular flange towards the first annular surface of the barrel of the sleeve.

7. The valve system of claim 1, wherein rim of the elastomeric valve contacts an annular surface of an interior wall surface of the interior region of the cap to form a first annular seal when the internal threads of the cap are fully threaded onto the external threads of the barrel.

8. The valve system of claim 7, wherein the annular surface of the cap includes an annular protrusion that contacts the rim of the elastomeric valve to compress and deform the rim of the elastomeric valve in at least a longitudinal direction that is parallel to a longitudinal axis of the barrel.

9. The valve system of claim 1, wherein the elastomeric valve includes a valve face that joins the annular wall of the elastomeric valve and spans the second end of the barrel;

wherein the valve face is concave towards the barrel; and wherein an interior wall surface of the interior region of the cap includes an annular protrusion that contacts the valve face when the internal threads of the cap are fully threaded onto the external threads of the barrel.

10. The valve system of claim 9, wherein the annular protrusion compresses the valve face at least in an outward radial direction relative to a longitudinal axis of the barrel.

11. The valve system of claim 1, wherein the barrel of the sleeve includes an annular lip or annular flange that protrudes inward towards a longitudinal axis of the barrel;

wherein a first annular surface of a terminal end of the spout contacts a second annular surface of the annular lip or annular flange to form a seal between the spout and the barrel of the sleeve.

12. The valve system of claim 1, wherein a pitch direction is the same for the external threads of the spout, the internal threads of the barrel, the external threads of the barrel, and the internal threads of the cap; and wherein a first turning resistance for unthreading the internal threads of the barrel relative to the external threads of the spout from a fully threaded state is substantially greater than a second turning resistance for unthreading the internal threads of the cap relative to the external threads of the barrel from a fully threaded state to thereby enable the cap to be unthreaded from the valve assembly without the sleeve being unthreaded from the spout in response to a relative turning force being applied between the cap and the spout.

13. The valve system of claim 12, wherein the sleeve includes a first locking catch formed at or near the first end of the barrel; and wherein the fitment or the fluid container includes a second locking catch that engages the first locking catch when the internal threads of the barrel and the external threads of the spout are in the fully threaded state to thereby provide the first turning resistance that is substantially greater than the second turning resistance.

14. The valve system of claim 1, wherein the elastomeric valve is a bite valve that is deformable to open the internal fluid pathway.

15. The valve system of claim 14, wherein the elastomeric valve includes two or more gate elements that collectively block the internal fluid pathway to close the internal fluid pathway.

16. The valve system of claim 1, wherein the sleeve includes a tamper-evident catch formed along an exterior of the sleeve; and wherein the cap includes a tamper-evident band that surrounds an opening of the interior region, the tamper evident band engaging the tamper-evident catch when the internal threads of the cap are initially threaded onto the external threads of the barrel, the tamper-evident catch damaging or deforming tamper-evident elements of the tamper-evident ring when the internal threads of the cap are unthreaded from the external threads of the barrel to provide a visual indication.

17. A valve system, comprising:

a spout of a fitment or fluid container, the spout having external threads;

a valve assembly including:

a sleeve forming a barrel that accommodates the spout within a first end of the barrel, the barrel including internal threads and external threads, the internal threads of the barrel engaging with the external threads of the spout, and an elastomeric valve located at a second end of the barrel, the elastomeric valve deformable to open and close an internal fluid pathway of the valve assembly, the elastomeric valve including an annular flange that protrudes outward from an annular wall of the elastomeric valve; a cap defining an interior region that includes internal threads that engage with the external threads of the barrel, the cap accommodating the elastomeric valve within the interior region when the internal threads of the cap are fully threaded onto the external threads of the barrel;

wherein the annular flange of the elastomeric valve is compressed between a first annular surface of the barrel of the sleeve and a second annular surface of an interior wall surface of the interior region of the cap in at least a longitudinal direction that is parallel to a longitudinal axis of the barrel of the sleeve to form a first annular seal when the internal threads of the cap are fully threaded onto the external threads of the barrel;

wherein a third annular surface of a terminal end of the spout contacts an annular wall portion of the annular wall of the elastomeric valve to form a second annular seal when the internal threads of the barrel are fully threaded onto the external threads of the spout; and wherein the annular wall portion of the elastomeric valve is compressed between the third annular surface of the spout and a fourth annular surface of an interior region of the barrel of the sleeve in at least a radial direction that is orthogonal to the longitudinal direction when the internal threads of the barrel are fully threaded onto the external threads of the spout.

18. The valve system of claim 17, wherein the sleeve includes a first locking catch formed at or near the first end of the barrel; and wherein the fitment or the fluid container includes a second locking catch that engages the first locking catch when the internal threads of the barrel and the external threads of the spout are in the fully threaded state.

19. The valve system of claim 17, further comprising the fluid container;

wherein the fluid container is a flexible pouch.

20. A valve system, comprising:

a spout of a fluid container or a fitment for a fluid container, the spout having external threads;

a valve assembly including:

a sleeve forming a barrel that accommodates the spout within a first end of the barrel, the barrel including internal threads and external threads, the internal threads of the barrel engaging with the external threads of the spout, and an elastomeric valve located at a second end of the barrel, the elastomeric valve operable to open and close an internal fluid pathway of the valve assembly; and a cap defining an interior region that includes internal threads that engage with the external threads of the barrel;

wherein the interior region of the cap includes annular wall surfaces that contact the elastomeric valve along a first annular region when the internal threads of the cap are fully threaded onto the external threads of the barrel to form a first annular seal; and wherein the spout includes annular wall surfaces that contact the elastomeric valve along a second annular region when the external threads of the spout are fully threaded onto the internal threads of the barrel to form a second annular seal.

* * * * *